US005708903A

United States Patent [19]

Kashino et al.

[11] Patent Number: 5,708,903

[45] Date of Patent: Jan. 13, 1998

[54] PROCESSING APPARATUS FOR LIGHT-SENSITIVE MATERIALS

[75] Inventors: Teruo Kashino; Yorikatsu Miyazawa; Hideo Ishii; Yutaka Teraoka; Takao Tsuda; Kazushige Aoki; Kazuya Tsukada; Shoji Nishio, all of Hino, Japan

[73] Assignee: Konica Corporation, Tokyo, Japan

[21] Appl. No.: 517,536

[22] Filed: Aug. 21, 1995

[30] Foreign Application Priority Data

| | | | |
|---|---|---|---|
| Aug. 26, 1994 | [JP] | Japan | 6-202179 |
| Sep. 1, 1994 | [JP] | Japan | 6-234209 |
| Sep. 29, 1994 | [JP] | Japan | 6-235482 |

[51] Int. Cl.[6] ..... G03D 3/02; G03D 13/00

[52] U.S. Cl. ..... 396/568; 396/622; 396/627; 396/630

[58] Field of Search ..... 354/298, 319–325; 430/30, 398–400; 134/64 P, 64 R, 122 P, 122 R; 396/568, 622, 626, 627, 630

[56] References Cited

U.S. PATENT DOCUMENTS

| | | | |
|---|---|---|---|
| 4,796,042 | 1/1989 | Mappin et al. | 354/324 |
| 4,857,950 | 8/1989 | Takase et al. | 354/324 |
| 5,400,105 | 3/1995 | Kobashi et al. | 354/324 |
| 5,459,545 | 10/1995 | Tsubaki et al. | 354/324 |
| 5,460,926 | 10/1995 | Komatsu et al. | 354/324 X |

FOREIGN PATENT DOCUMENTS

| | | | |
|---|---|---|---|
| 0 306 976 | 3/1989 | European Pat. Off. . | |
| 0 595 312 A1 | 5/1994 | European Pat. Off. . | |
| 5-127341 | 5/1993 | Japan | 354/328 |
| WO 92/20013 | 11/1992 | WIPO . | |

*Primary Examiner*—D. Rutledge

*Attorney, Agent, or Firm*—Frishauf, Holtz, Goodman, Langer & Chick, P.C.

[57] ABSTRACT

An apparatus for processing a light-sensitive material includes a supply controlling section for controlling an amount of solid processing agents to be supplied per a unit time period in accordance with an amount of the light-sensitive material to be processed per a unit time period.

31 Claims, 22 Drawing Sheets

| Water solution | Light - sensitive material | |
|---|---|---|
| Sodium carbonate | MGH - SH | ○——○ |
| | CR3B | ○---○ |
| Sodium bicarbonate | MGH - SR | △——△ |
| | CR3B | △---△ |
| Sodium citrate | MGH - SR | □——□ |
| | CR3B | □---□ |
| Pooled water | MGH - SR | ×——× |
| | CR3B | ×---× |

PROCESSING APPARATUS FOR LIGHT-SENSITIVE MATERIALS

BACKGROUND OF THE INVENTION

The present invention relates to a processing apparatus for light-sensitive materials wherein compactness and easy operation have been attained, stability of chemicals has been improved greatly, and low replenishment is easily achieved.

In the processing apparatus for light-sensitive materials, light-sensitive materials such as monochromatic printing plates and X-ray films for medical use are processed, after exposure, through the steps of developing, desilvering and washing. For developing, black and white developing solutions are used, for desilvering step, bleaching solutions and fixing solutions are used, and for washing, tap water is used. Liquids having processing functions for conducting the processing steps mentioned above are called a processing solution.

For these processings, a system to replenish processing solutions is employed commonly for maintaining activity of processing solutions in processing tanks. To be concrete, processing operations are carried out while replenishers are being supplied to processing tanks from replenisher tanks on a timely basis. In this case, it is common that replenishers themselves stored in the replenisher tank are prepared at a different place and replenished to a tank for replenishment when necessary. However, a method of manual operation as follows has hitherto been employed.

Namely, processing agents for light-sensitive materials (hereinafter referred to also as photographic processing agents) are available on the market in the form of powder or a liquid, and when using it, powder is dissolved manually in water of a certain amount for preparation of a solution, while a liquid is diluted with water of a certain amount for the use because the liquid is concentrated. A replenishing tank is sometimes provided on the side of the processing apparatus for light-sensitive materials, which makes it necessary to secure a considerable space.

Accordingly, when a processing tank wherein a processing solution for processing light-sensitive materials is contained is communicated with a dissolving tank, for example, and when this dissolving tank is supplied with solid processing agents for dissolution in accordance with a condition of the processing solution, compactness of the processing apparatus for light-sensitive materials can be attained, manual dissolving operation can be eliminated and thereby a processing system with stable photographic performance can be achieved. In addition to that, there can be achieved a low-pollution system wherein the use of polyethylene containers which have been used for containing photographic processing agents can be reduced or eliminated.

However, since light-sensitive materials such as a monochromatic printing plate and an X-ray film are large in size, compared with films handled in photofinishing laboratories, it is necessary to increase an amount of solid processing agents to be supplied or to increase the dissolving speed of the solid processing agent.

However, when an amount of solid processing agent to be supplied is increased or the dissolving speed of the solid processing agent is increased, there is a risk that foam may tend to be generated to deteriorate uniformity of a processing solution causing uneven processing and lowered dissolving speed, resulting in quality that is lower than that in a conventional concentrated solution system.

On the processing apparatus for light-sensitive materials wherein solid processing agents are replenished to a processing solution, for processing light-sensitive materials, each time light-sensitive materials in a prescribed quantity are processed, solid processing agents are replenished every time light-sensitive materials of a prescribed quantity are processed. However, when processing of light-sensitive materials in a small amount is continued, time required to reach a prescribed amount of processed light-sensitive materials is long, and during that period, fatigue of dissolved processing agent is caused. As a result, it was found that processing of light-sensitive materials tends to be insufficient.

Therefore, there is desired, in particular, a processing apparatus for light-sensitive materials which can offer accurate processing even when processing of light-sensitive materials in a small amount is continued.

An object of the invention is to provide a processing method and a processing apparatus both for light-sensitive materials wherein performance of processing light-sensitive materials is improved by replenishing solid processing agents at constant time intervals.

SUMMARY OF THE INVENTION

The present invention has been achieved in consideration of the above-mentioned points, and its first object is to provide a processing apparatus for light-sensitive materials wherein concentration of a processing solution can be stabilized by replenishing solid processing agents. The second object of the invention is to provide a processing apparatus for light-sensitive materials wherein occurrence of foam can be prevented by replenishing solid processing agents. Third object of the invention is to provide a processing apparatus for light-sensitive materials wherein a large amount of solid processing agents can be supplied. Further, the fourth object of the invention is to provide a processing apparatus for light-sensitive materials wherein the degree of alkali can be stabilized by a simple structure.

To achieve the above-mentioned objects, a processing apparatus for light-sensitive materials of the invention is characterized to be provided with a processing tank where processing solutions for processing light-sensitive materials are contained, a dissolving tank that is communicated with the processing tank to dissolve supplied solid processing agents, a solid processing agent supply section that supplies the aforesaid solid processing agents to the dissolving tank, and a supply controlling section that controls an amount of the aforesaid solid processing agents to be supplied per a unit time period depending on an amount of the light-sensitive materials processed per a unit time period.

It is preferable that the aforesaid supply controlling section controls an amount of the aforesaid solid processing agents to be supplied per a unit time period in accordance with an amount of the aforesaid light-sensitive materials processed per a unit time period based on the detection from a detecting means that detects the processing situation for the light-sensitive materials mentioned above.

It is preferable that there are processing systems for light-sensitive materials including intermittent processing and continuous processing, and an amount of supply per a unit time period for solid processing agent in the intermittent processing is made small, while an amount of supply per a unit time period for solid processing agent in the continuous processing is made large, and an amount of supply per a unit time period for solid processing agent in the course of switching from the intermittent processing to the continuous processing is made larger than an amount of supply per a unit time period in the continuous processing.

It is preferable that there are processing systems for light-sensitive materials including intermittent processing and continuous processing, and an amount of supply per a unit time period for solid processing agent in the intermittent processing is made small, while an amount of supply per a unit time period for solid processing agent in the continuous processing is made large, and an amount of supply per a unit time period for solid processing agent in the course of switching from the continuous processing to the intermittent processing is made smaller than an amount of supply per a unit time period in the intermittent processing.

It is preferable that there are processing systems for light-sensitive materials including intermittent processing and continuous processing, and an amount of supply per a unit time period for solid processing agent in the intermittent processing is made small, while an amount of supply per a unit time period for solid processing agent in the continuous processing is made large, and the start of supply of the solid processing agent in the course of switching from intermittent processing to continuous processing is made earlier by a predetermined time than the start of conveyance of the aforesaid light-sensitive material.

It is preferable that there are processing systems for light-sensitive materials including intermittent processing and continuous processing, and an amount of supply per a unit time period for solid processing agent in the intermittent processing is made small, while an amount of supply per a unit time period for solid processing agent in the continuous processing is made large, and the start of supply of the solid processing agent in the course of switching from continuous processing to intermittent processing is made later by a predetermined time than the start of conveyance of the aforesaid light-sensitive material.

It is preferable to control an amount of the aforesaid solid processing agent for each supply operation and thereby to change depending on an amount of the aforesaid light-sensitive materials processed per a unit time period.

A processing apparatus for light-sensitive materials of the invention is characterized to be provided with a processing tank where a processing solution for processing light-sensitive materials is contained, a dissolving tank that is communicated with the processing tank to dissolve supplied solid processing agents, a solid processing agent supply section that supplies the aforesaid solid processing agents to the dissolving tank, a compulsory dissolving means that dissolves the solid processing agents compulsorily, and s dissolution control section that controls the aforesaid compulsory dissolving means and thereby to control dissolving speed of the above-mentioned solid processing agent depending on an amount of the light-sensitive materials processed per a unit time period.

It is preferable that the aforesaid dissolution controlling section controls dissolving speed of the aforesaid solid processing agent in accordance with an amount of the aforesaid light-sensitive materials processed per a unit time period based on the detection from a detecting means that detects the processing situation for the light-sensitive materials mentioned above.

It is preferable that the aforesaid compulsory dissolving means changes a liquid flow in the dissolving tank, or changes vibration to be given to the liquid.

It is preferable that a plurality of concentration sensors are arranged in the direction perpendicular to the conveyance direction for a light-sensitive material in the processing tank, and dissolving speed of the solid processing agent is controlled based on concentration information from the concentration sensors.

It is preferable that the compulsory dissolving means changes the surface area of solid processing agents to be supplied to the dissolving tank.

It is preferable that there are processing systems for light-sensitive materials including intermittent processing and continuous processing, and dissolving speed of the solid processing agent in the intermittent processing is made lower, while dissolving speed of the solid processing agent in the continuous processing is made faster, and dissolving speed of the solid processing agent in the course of switching from intermittent processing to continuous processing is made faster than dissolving speed in the continuous processing.

It is preferable that there are processing systems for light-sensitive materials including intermittent processing and continuous processing, and dissolving speed of the solid processing agent in the intermittent processing is made lower, while dissolving speed of the solid processing agent in the continuous processing is made faster, and dissolving speed of the solid processing agent in the course of switching from continuous processing to intermittent processing is made slower than dissolving speed in the intermittent processing.

It is preferable that there are processing systems for light-sensitive materials including intermittent processing and continuous processing, and dissolving speed of the solid processing agent in the intermittent processing is made lower, while dissolving speed of the solid processing agent in the continuous processing is made faster, and dissolving speed control of the solid processing agent in the course of switching from intermittent processing to continuous processing is started earlier by a predetermined time period than the start of conveyance of the aforesaid light-sensitive material.

It is preferable that there are processing systems for light-sensitive materials including intermittent processing and continuous processing, and dissolving speed of the solid processing agent in the intermittent processing is made lower, while dissolving speed of the solid processing agent in the continuous processing is made faster, and dissolving speed control of the solid processing agent in the course of switching from continuous processing to intermittent processing is started later by a predetermined time period than the start of conveyance of the aforesaid light-sensitive material.

A processing apparatus for light-sensitive materials of the invention consists of a processing tank that contains a processing solution that processes a light-sensitive material, a conveyance means that conveys the processing tank and the light-sensitive material and immerses in the processing solution, a dissolving tank that is communicated with the processing tank and dissolves solid processing agents supplied, a solid processing agent supply means that supplies the solid processing agents to the dissolving tank, and a concentration distribution adjusting means that adjusts the dispersion of concentration of the processing solution in the direction perpendicular to the conveyance direction for light-sensitive materials in the processing tank to be within 5%.

The concentration distribution adjusting means is a circulating means that generates a plurality of circulation flows of a processing solution between the processing tank and the dissolving tank.

It is preferable that at least one of the plural circulation flows is a circulating means in the direction perpendicular to the conveyance direction for light-sensitive materials.

It is preferable that a plurality of concentration sensors are provided in the direction perpendicular to the conveyance direction for light-sensitive materials in the dissolving tank, and a control means that controls the concentration distribution adjusting means based on concentration information from the plural concentration sensors is provided.

It is preferable that there is provided, independently of the processing tank, a circulating means only for the dissolving tank so that a processing solution circulates only in the dissolving tank.

It is preferable that the circulating means is provided with a plurality of nozzles for jetting out circulation flows into the processing tank, and at least one of the nozzles has a shape that spreads a jetting flow into the processing tank.

It is preferable that a filter means is provided between the dissolving tank and the processing tank.

It is preferable that a foam preventing means that prevents occurrence of foam is provided on the aforesaid dissolving tank.

It is preferable that a supersonic wave generating means that generates supersonic waves, a low frequency generating means that generates low frequencies, or an antifoaming agent mixed in the aforesaid solid processing agent is used for constituting the above-mentioned foam preventing means.

It is preferable that a cartridge accommodating plural solid processing agents is set on a replenishing unit having casters, and the replenishing unit is provided with a moving means that moves the cartridge to a predetermined supply position and a supply means that supplies plural solid processing agents in the cartridge set to the supply position to the aforesaid dissolving tank.

It is preferable that a cartridge accommodating plural solid processing agents is set on a replenishing unit having casters, the cartridge set on the replenishing unit is moved to the upper position by an elevating means, the plural solid processing agents in the cartridge are taken in the aforesaid solid processing agent supply section arranged on a top plate that covers the upper portion of the processing tank, and the solid processing agents are supplied to a dissolving tank by the solid processing agent supply section.

It is preferable that a cartridge accommodating plural solid processing agents is set on a replenishing unit having casters, solid processing agents in the cartridge set on the replenishing unit are taken in the aforesaid solid processing agent supply section arranged on a top plate that covers the upper portion of the processing tank, or the solid processing agents are supplied directly to a dissolving tank.

It is preferable that a cartridge accommodating a block-shaped solid processing agent is set on a replenishing unit having casters, and the replenishing unit is provided with a moving means that moves the block-shaped solid processing agent to a predetermined supply position and a supply means that supplies the block-shaped solid processing agent set to the supply position to the dissolving tank.

It is preferable that a processing apparatus for light-sensitive materials of the invention is provided with a processing tank containing a processing solution for processing light-sensitive materials, a washing tank containing a washing solution for washing processed light-sensitive materials, a dissolving tank that dissolves alkali solid adjusting agent that is supplied through communication with the washing tank, and an alkali solid adjusting agent supply section that supplies the alkali solid adjusting agent to the dissolving tank.

It is preferable that a processing apparatus for light-sensitive materials of the invention is provided with a detecting means that detects a processing amount of the aforesaid light-sensitive materials or a PH value of washing water, and an adjusting agent supply controlling section that controls an amount of the aforesaid alkali solid adjusting agents to be supplied in accordance with the detection.

In the invention, an amount of solid processing agents to be supplied per a unit time period is controlled depending on an amount of light-sensitive materials processed per a unit time period, and thereby concentration of a processing solution is stabilized.

In the invention, when dissolving a large amount of solid processing agents, dissolving speed of solid processing agents is controlled depending on an amount of light-sensitive materials processed per a unit time period, and thereby concentration of a processing solution is stabilized, because natural dissolution can not make concentration to be stabilized.

In the invention, occurrence of foam caused in a dissolving tank by dissolution of solid processing agents is prevented, uniformity of a processing solution is improved, unevenness of processing is prevented, and dissolving speed is enhanced.

In the invention, a large amount of solid processing agents can be supplied.

In the invention, it is preferable that the alkaline degree of washing water is stabilized by dissolving alkali solid adjusting agents.

DETAILED DESCRIPTION OF THE PREFERRED EMBODIMENT

Figure 1:
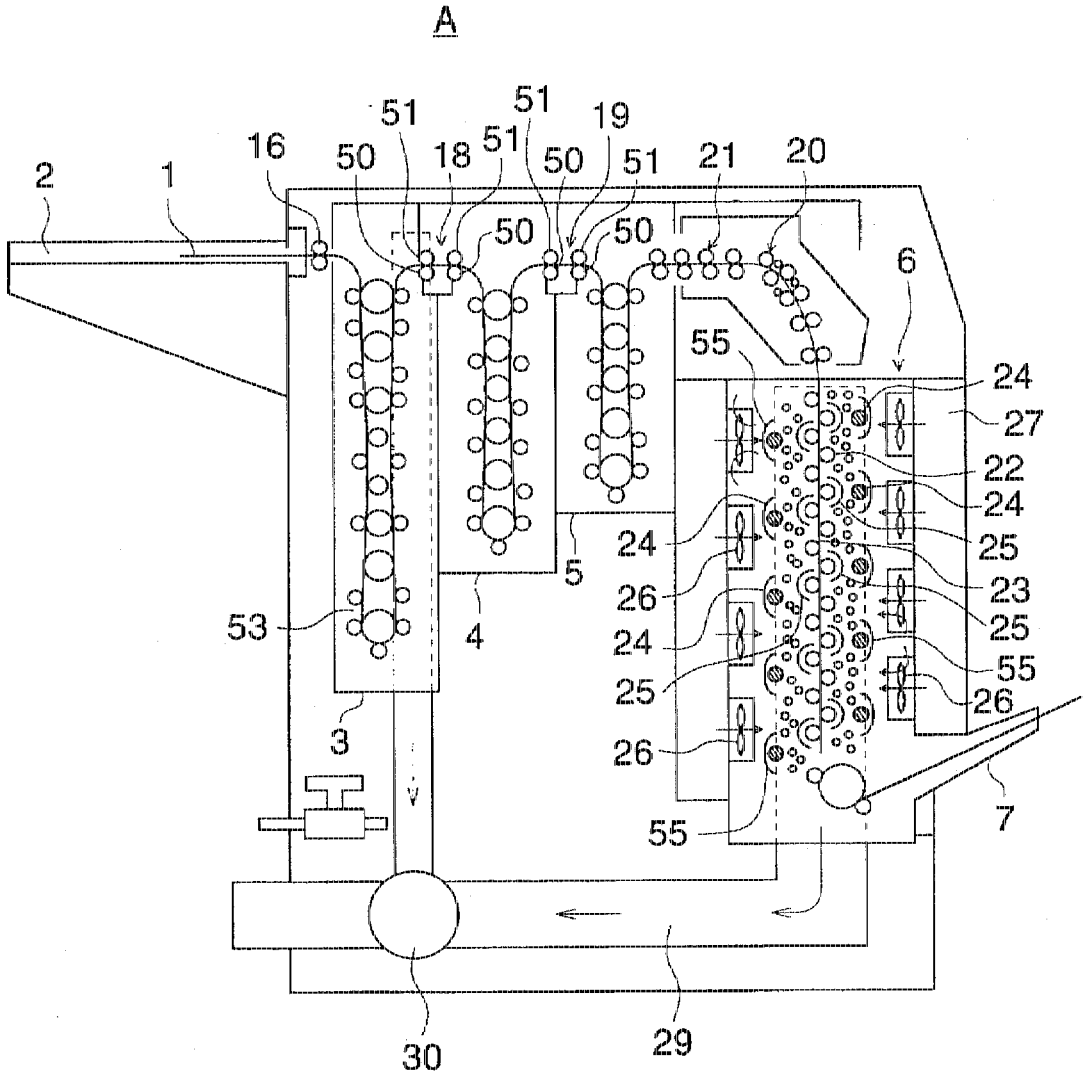
FIG. 1 is a structural diagram of a processing apparatus for light-sensitive materials.

Examples of the processing apparatus for light-sensitive materials of the invention will be explained as follows. First of all, the processing apparatus for light-sensitive materials to which the invention is applied will be explained.

This processing apparatus for light-sensitive materials A is one for processing an X-ray film for medical use wherein light-sensitive material 1 is transported successively through developing tank 3, fixing tank 4 and washing tank 5 in a processing tank to be processed, and the light-sensitive material 1 thus processed is sent to drying section 6 to be dried, and then is delivered to delivery tray 7.

Light-sensitive material 1 is conveyed by transport roller 16 to a processing tank through inserting section 2, and then is conveyed automatically by transport means 53 composed of a transport roller to developing tank 3, fixing tank 4 and washing tank 5 which are all in the processing tank. There are provided cross-over racks 18 and 19 respectively between the developing tank 3 and the fixing tank 4 and between fixing tank 4 and the washing tank 5. Each of the cross-over racks 18 and 19 serves to send light-sensitive material 1 smoothly to the following processing tank and to prevent that a processing solution is carried over to the following processing tank to be mixed with a solution in that tank.

On the rear part of washing tank 5 provided with a pair of cross-over racks 50 and 51 arranged vertically to face the aforesaid cross-over racks 18 and 19, there is provided liquid-eliminating section 20 in which light-sensitive material 1 is squeezed by roller group 21, and washing water adhering to the light-sensitive material is squeezed off or soaked up, and then the light-sensitive material is sent to drying section 6.

In the drying section 6, there is provided feed roller group 22 that conveys light-sensitive material 1, while, infrared ray heater 24 which is a source of an infrared ray is arranged at predetermined intervals along conveyance path 23 formed by the feed roller group 22 so that the infrared ray heater may face both sides of the light-sensitive material 1. This infrared ray heater 24 is formed to be bar-shaped and is arranged to be perpendicular to the direction of conveyance for the light-sensitive material 1 so that it may apply infrared rays to both sides of the light-sensitive material 1 to dry it.

On the feed roller located in the vicinity of the infrared ray heater 24, there is provided heat resisting guide 25 so that overheat of the feed roller may be prevented. There is also provided heat resisting guide 55 on an inner wall side of the drying section 6 so that the heat resisting guide may cover the infrared ray heater 24, thus overheat of air blasting fan 26 and open air duct 27 can be prevented. From this air blasting fan 26 and the open air duct 27, air is blown against the light-sensitive material 1 to eliminate evaporated moisture located in space near the surface of the light-sensitive material 1 to be dried so that the light-sensitive material can easily be dried.

In order to prevent that internal pressure of the drying section 6 is raised by the outside air taken in by the air blasting fan 26 and by moisture evaporated from the light-sensitive material 1, exhaust air is led by exhaust duct 29 from a large number of air outlets 28 provided on side walls of the drying section 6, and is ejected out of an apparatus by exhaust fan 30 together with air from the upper portion covering developing tank 3 through washing tank 5.

Figure 2:
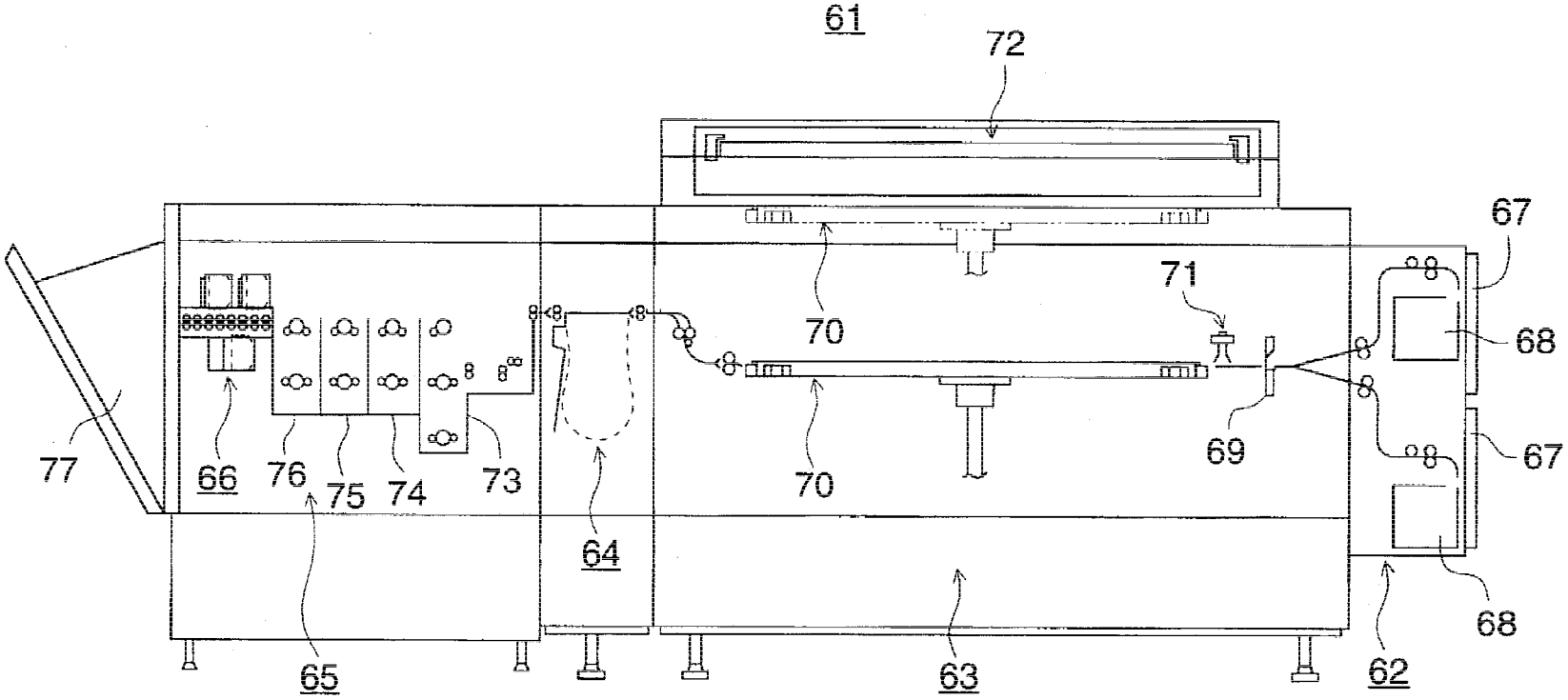
FIG. 2 is a structural diagram of an image forming apparatus.

Next, an image forming apparatus shown in FIG. 2 to which the invention is applied will be explained as follows. FIG. 2 represents a front view of the image forming apparatus equipped with a light-sensitive material processor.

This image forming apparatus 61 is an apparatus for obtaining a proof sheet which is used for inspecting whether a layout of a manuscript copy is wrong or not, whether colors are wrong or not, or whether characters are wrong or not, before preparing a regular printing plate by the use of color-separated originals of Y plate, M plate, C plate and B plate. On this image forming apparatus 61, there are provided paper feed section 62, exposure section 63, accumulating section 64, processing tanks 65 and drying section 66, and light-sensitive material processor A is composed of the processing tanks 65 and the drying section 66.

In the paper feed section 62, there are set cartridges 68 in which long roll light-sensitive materials are loaded respectively after opening covers 67 at upper and lower positions. The light-sensitive material of a roll type is conveyed from the cartridge 68 to exposure section 63. On the paper feed section side of the exposure section 63, there is provided cutter 69 which cuts the light-sensitive material of a roll type fed out of the cartridge 68 into a predetermined length to prepare a light-sensitive material of a sheet type. In the exposure section 63, there is provided exposure stand 70 to be movable vertically, ant its lower position is a setting position where the light-sensitive material of a sheet type is set and its upper position is an exposure position for contact printing. The exposure section 63 is further provided with sucker conveyance mechanism 71 which sucks a leading edge of the light-sensitive material of a sheet type and sets it to a predetermined position on the exposure stand 70.

After the light-sensitive material of a sheet type is set on the exposure stand 70, the exposure stand 70 is moved to the exposure position at the upper part where the light-sensitive material of a sheet type is brought into contact with a plurality of originals and is subjected to exposure made by light source unit 72 from the original side. In this way, in the exposure section 63, one or plural color-separated originals are positioned and superimposed on a color light-sensitive material for successive contact printing in accordance with separated colors corresponding to the original.

The light-sensitive material of a sheet type thus exposed is conveyed to processing tank 65 through accumulating section 64, and then is processed in developing tank 73, fixing tank 74 and stabilizing tanks 75 and 76 all located in the processing tanks 5. Then, the processed light-sensitive material is dried by drying section 66, and the light-sensitive material of a sheet type is ejected to basket 77. By preparing a color proof using this processed light-sensitive material of a sheet type, it is possible to discover wrong color-separated originals and to make sure the finish of printing in advance. Thus, the work of returning color-separated original proofing can be conducted in an early stage.

Figure 20:
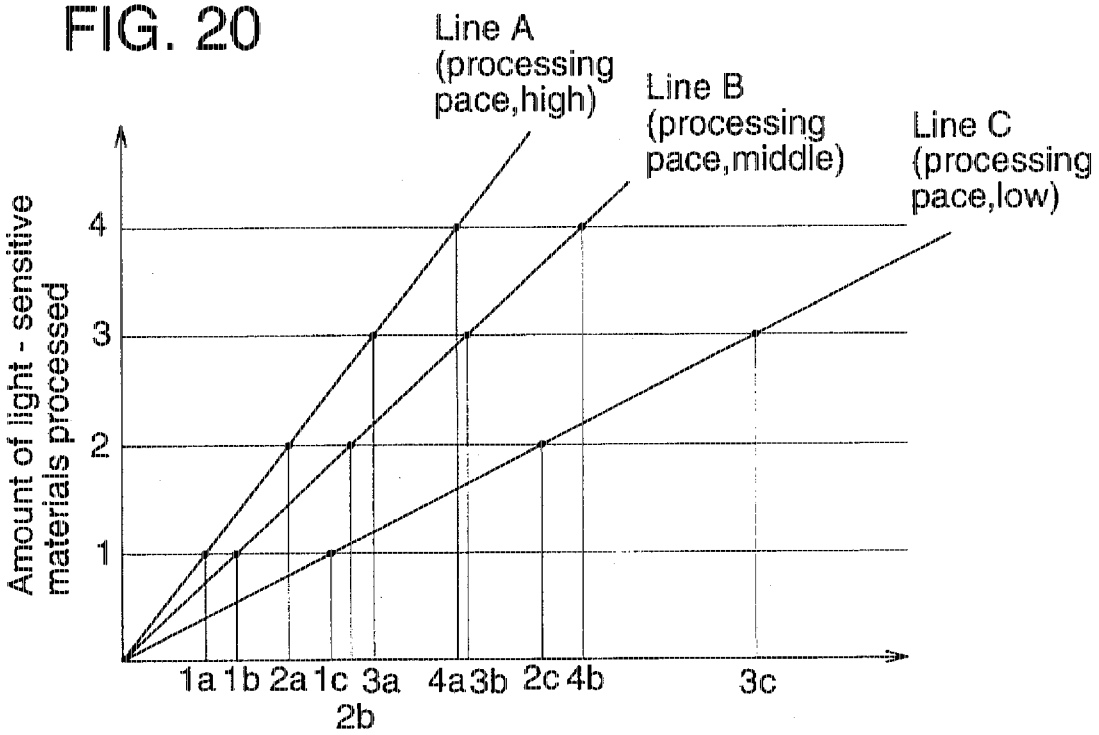
FIGS. 20 and 21 are diagrams showing respectively the relation between the time for supplying solid processing agents and an amount of light-sensitive materials processed.

Now, a principle of the present invention will be explained as follows. The invention is on the assumption that solid processing agents are supplied depending on an amount of light-sensitive materials processed. FIG. 20 shows the relation between a time interval for supplying solid processing agents and an amount of light-sensitive materials processed in an embodiment wherein solid processing agents are supplied when an amount of processed light-sensitive materials has reached a predetermined amount. In the figure, three kinds of paces for processing light-sensitive materials are shown. Each point on the axis of time in FIG. 20 represents timing for supplying solid processing agents, and 1*a* represents the first supply of solid processing agent on the occasion of supplying at a processing pace shown with line A. As is apparent from FIG. 20, it is understood that the slower the pace of processing light-sensitive material is, the greater an interval 6f supplying solid processing agent is. In addition, an amount of solid processing agents supplied in one occasion is constant independently of the processing pace, because of an embodiment wherein solid processing agents are supplied with an amount of light-sensitive materials as a threshold value. Therefore, the problem of fatigue of a processing solution mentioned above is caused.

Figure 21:
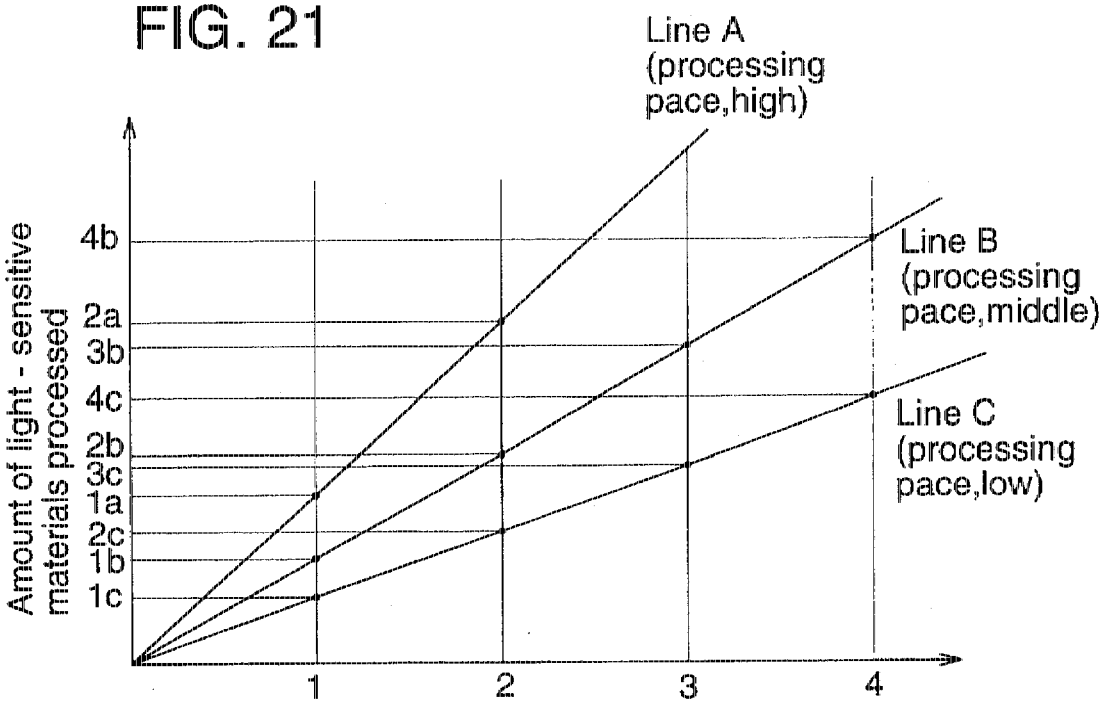

On the other hand, FIG. 21 shows the relation between a time interval for supplying solid processing agents and an amount of light-sensitive materials processed in an embodiment wherein solid processing agents are supplied when a predetermined time period has passed In the figure, three kinds of paces for processing light-sensitive materials are shown. Each point on the axis of an amount of light-sensitive materials processed in FIG. 21 represents an amount of processed light-sensitive materials corresponding to the moment of supplying solid processing agents, and 1*a* represents the first supply of solid processing agents on the occasion of processing pace shown with line A. As is apparent from FIG. 21, it is understood that an amount of solid processing agents to be supplied for one occasion can be small when the pace of processing light-sensitive materials is low. Therefore, even when using processing agents whose dissolving speed is low, fluctuation in concentration of a processing solution is hardly caused. In addition, if an interval of supplying solid processing agents can be established in consideration of fatigue of a processing solution, the problem of fatigue of a processing solution mentioned above is not caused.

From a point of view above, the invention is characterized in that a supply of solid processing agents is controlled so that solid processing agents in the quantity depending on an amount of light-sensitive materials processed may be supplied at prescribed intervals.

Figure 3:
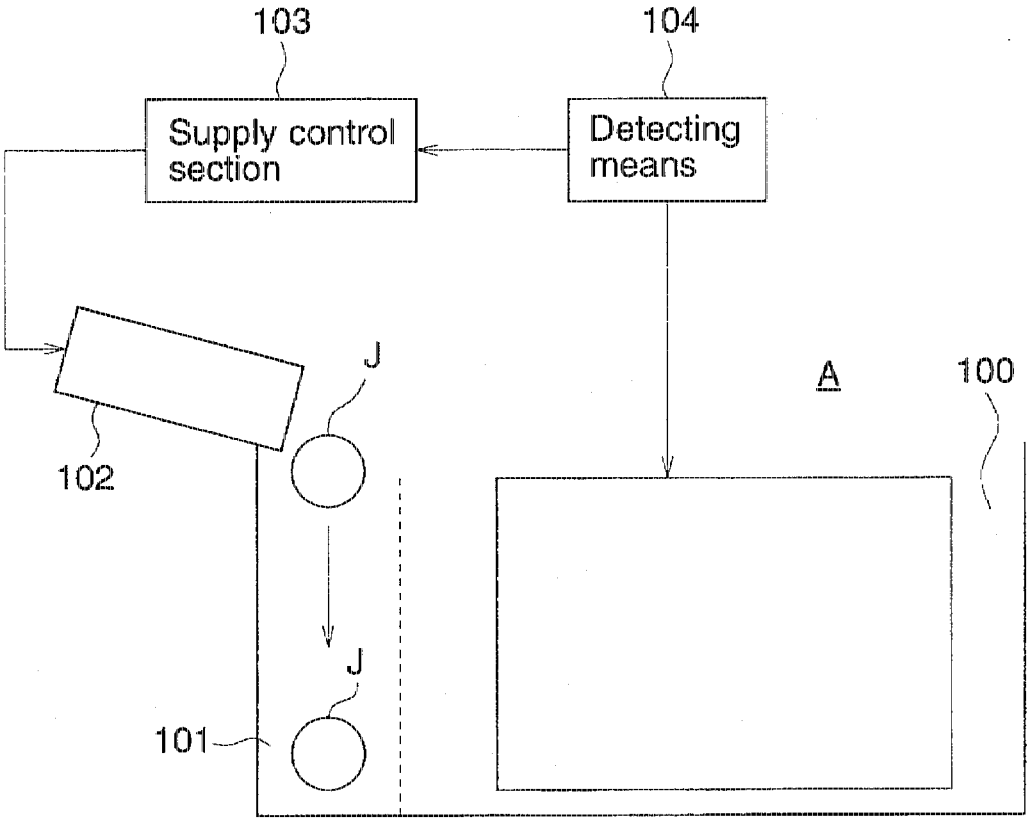
FIG. 3 is a structural diagram of a concrete example of a processing apparatus for light-sensitive materials.
Figure 4:
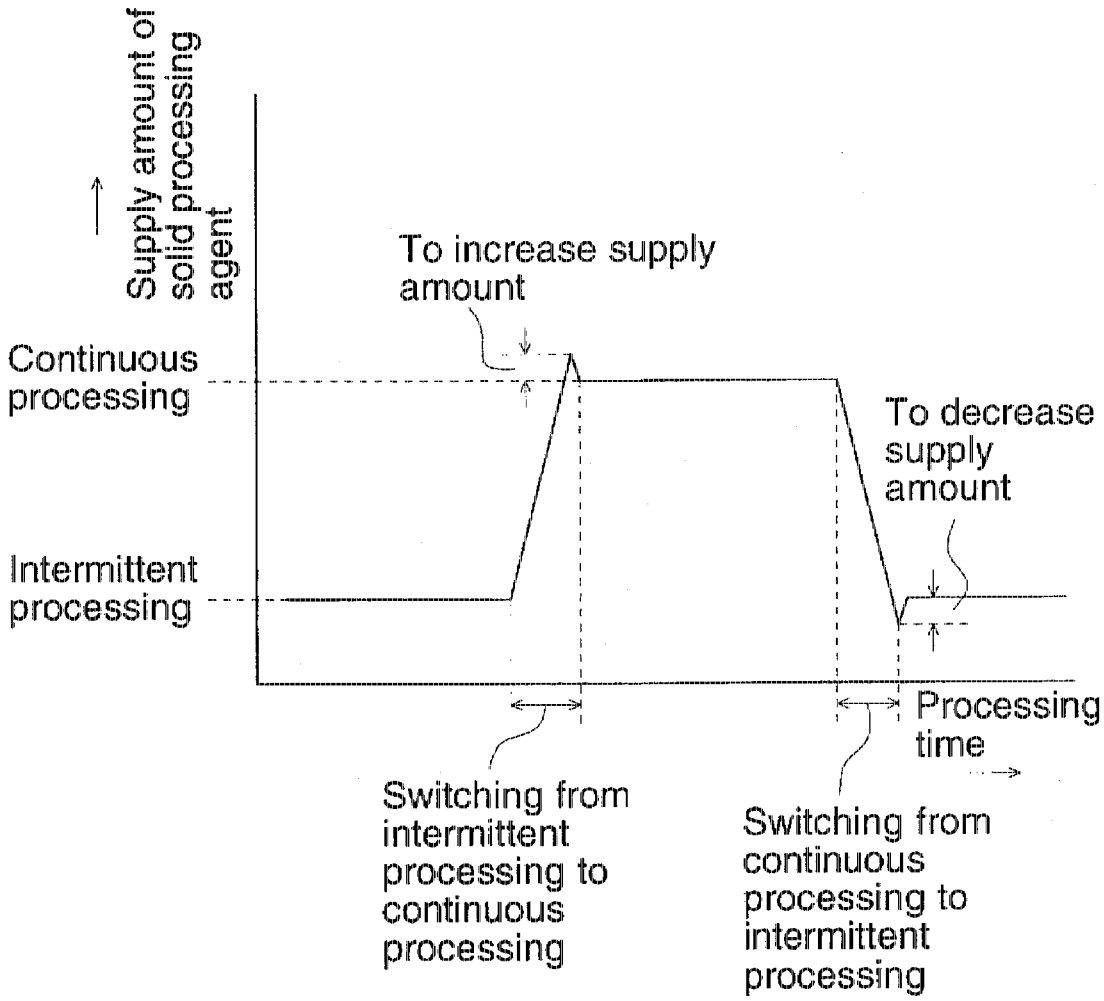
FIG. 4 is a structural diagram of another example of supply control for solid processing agents in a processing apparatus for light-sensitive materials.
Figure 5:
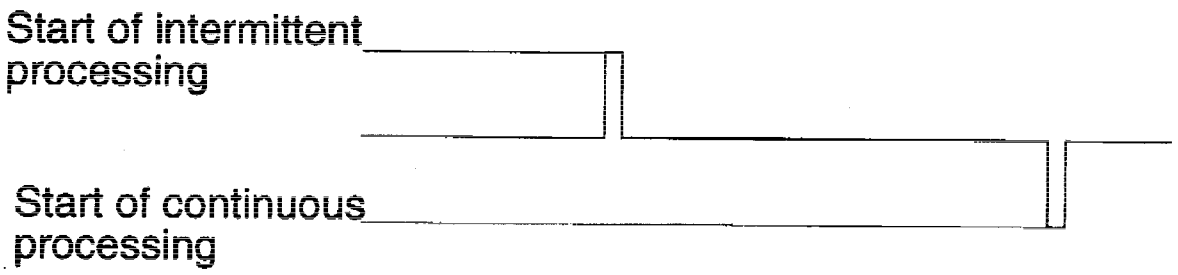
FIGS. 5(*a*) and 5(*b*) is a structural diagram of other example of supply control for solid processing agents in a processing apparatus for light-sensitive materials.
Figure 5:
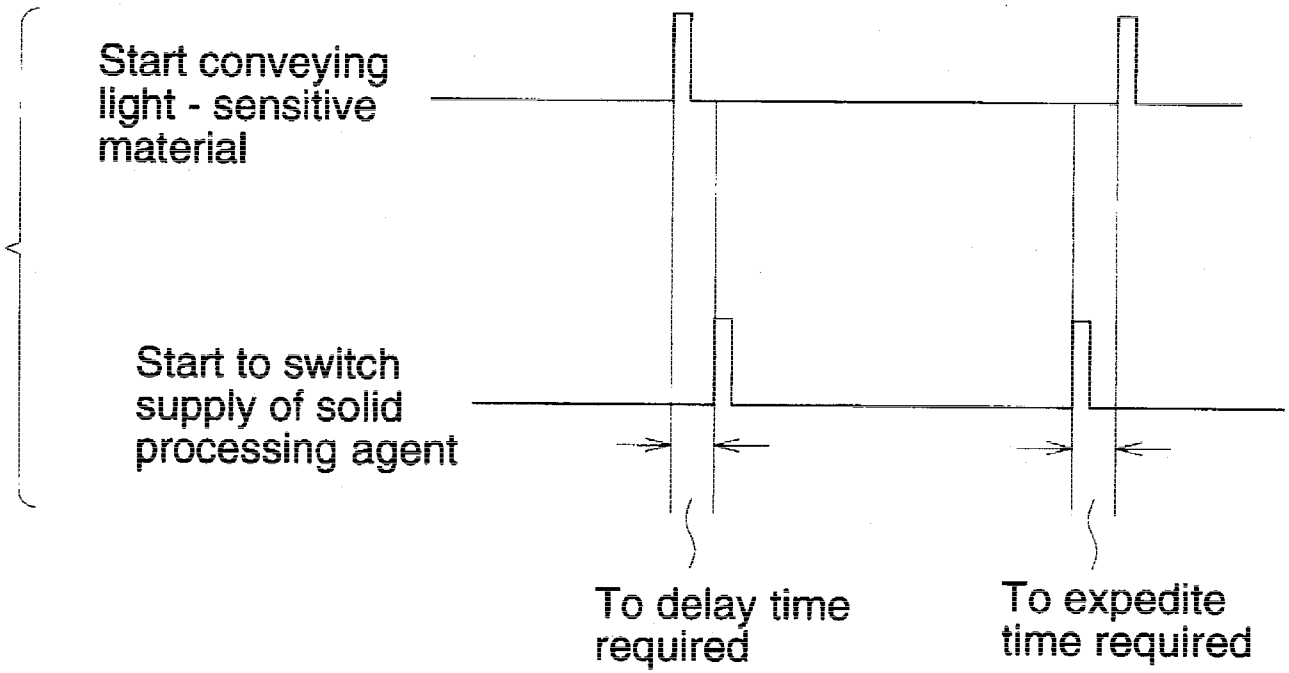

The processing apparatus for light-sensitive materials in the invention is applied to developing tank 3 and fixing tank 4 both in a processing tank of the processing apparatus for light-sensitive materials A in FIGS. 1 and 2, and concrete examples are shown in FIGS. 3 through 5(*a*) and 5(*b*).

As shown in FIG. 3, the processing apparatus for light-sensitive materials A is provided with processing tank 100 where a processing solution for processing light-sensitive materials is contained, dissolving tank 101 that is communicated with the processing tank 100 to dissolve solid processing agent J supplied, solid processing agent supply section 102 for supplying solid processing agent J to the dissolving tank 101 and with supply control section 103 that controls an amount of solid processing agent J to be supplied depending on an amount of light-sensitive materials processed per a unit time period. The supply control section 103 controls an amount of solid processing agent J to be supplied per a unit time period depending on an amount of light-sensitive materials per a unit time period based on detection made by detecting means 104 that detects the processing situation for light-sensitive materials. An amount of light-sensitive materials per a unit time period is detected by the number of processed sheets of light-sensitive material per a predetermined time period or the like. Solid processing agent J is formed, for example, to be granule-shaped, tablet-shaped or block-shaped.

As shown in FIG. 4, the processing apparatus for light-sensitive materials A has processing systems for light-sensitive materials including intermittent processing and continuous processing. The intermittent processing represents an occasion where light-sensitive materials are supplied manually to the processing apparatus for light-sensitive materials A by an operator, for example, while, the continuous processing represents an occasion where light-sensitive materials are supplied for processing automatically to the processing apparatus for light-sensitive materials A by an autofeeder connected thereto, for example.

Concentration of a processing solution is stabilized in the manner wherein an amount of supply per a unit time period for solid processing agent J in intermittent processing is made small, an amount of supply per a unit time period for solid processing agent J in continuous processing is made large, and the amount of supply per a unit time period for solid processing agent J is controlled in accordance with an amount of light-sensitive materials per a unit time period. Moreover, concentration of a processing solution is stabilized by improving a response in switching by the manner wherein an amount of supply per a unit time period for solid processing agent J is made larger than that in continuous processing in the case of switching from intermittent processing to continuous processing, on the other hand, an amount of supply per a unit time period for solid processing agent J in the case of switching from continuous processing to intermittent processing is made smaller than that in intermittent processing. A method wherein adjustment is made only in the case of switching from intermittent processing to continuous processing or from continuous processing to intermittent processing is also acceptable naturally.

Further, concentration of a processing solution is stabilized by improving a response in switching by the manner wherein an amount of supply per a unit time period for solid processing agent J in intermittent processing is made small and an amount of supply per a unit time period for solid processing agent J in continuous processing is made large as shown in FIGS. 5(*a*) and 5(*b*) in the processing apparatus for light-sensitive materials A and the start of supply of solid processing agent J is made earlier than the start of conveyance of light-sensitive material by a predetermined time period in switching from intermittent processing to continuous processing, while the start of supply of solid processing agent J is made to be behind the start of conveyance of light-sensitive material by a predetermined time period in switching from continuous processing to intermittent processing. A method wherein adjustment is made only in the case of switching from intermittent processing to continuous processing or from continuous processing to intermittent processing is also acceptable naturally.

It is also acceptable to change by controlling an amount of the aforesaid solid processing agent for each supply operation, depending on the amount of the aforesaid light-sensitive materials processed per a unit time period.

The processing apparatus for light-sensitive materials in the invention is applied to developing tank 3 and fixing tank 4 both in a processing tank of the processing apparatus for light-sensitive materials A shown in FIGS. 1 and 2, and more concrete examples are shown in FIGS. 6 through 12.

Figure 6:
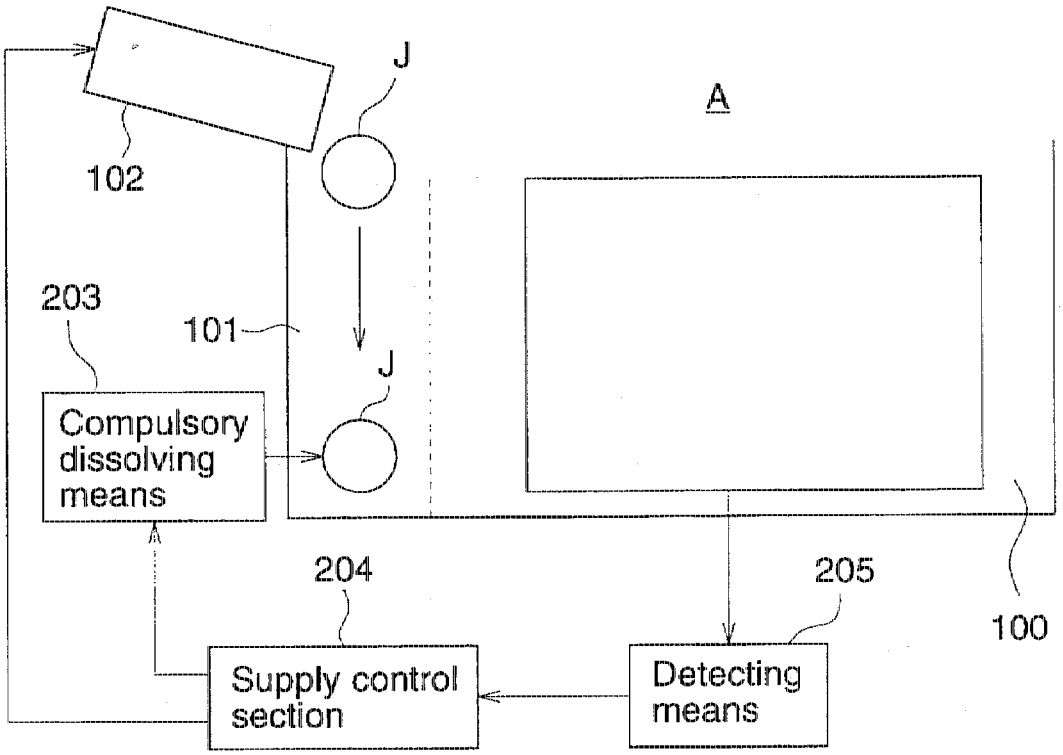
FIG. 6 is a structural diagram of another concrete example of a processing apparatus for light-sensitive materials.

As shown in FIG. 6, the processing apparatus for light-sensitive materials A is provided with processing tank 100 where a processing solution for processing light-sensitive materials is contained, dissolving tank 101 that is communicated with the processing tank 100 to dissolve solid processing agent J supplied, solid processing agent supply section 102 for supplying solid processing agent J to the dissolving tank 101, compulsory dissolution means 203 for dissolving solid processing agent J compulsorily and with dissolution control section 204 that controls speed of dissolving solid processing agent J in accordance with an amount of processing light-sensitive materials per a unit time period. The dissolution control section 204 controls a speed of dissolving solid processing agent J depending on an amount of light-sensitive materials per a unit time period based on detection made by detecting means 205 that detects the processing situation for light-sensitive materials. Owing to the control of the dissolution control section 204, the compulsory dissolution means 203 changes the liquid flow in the dissolution tank 101, or changes vibration to be given to the solution.

Figure 7:
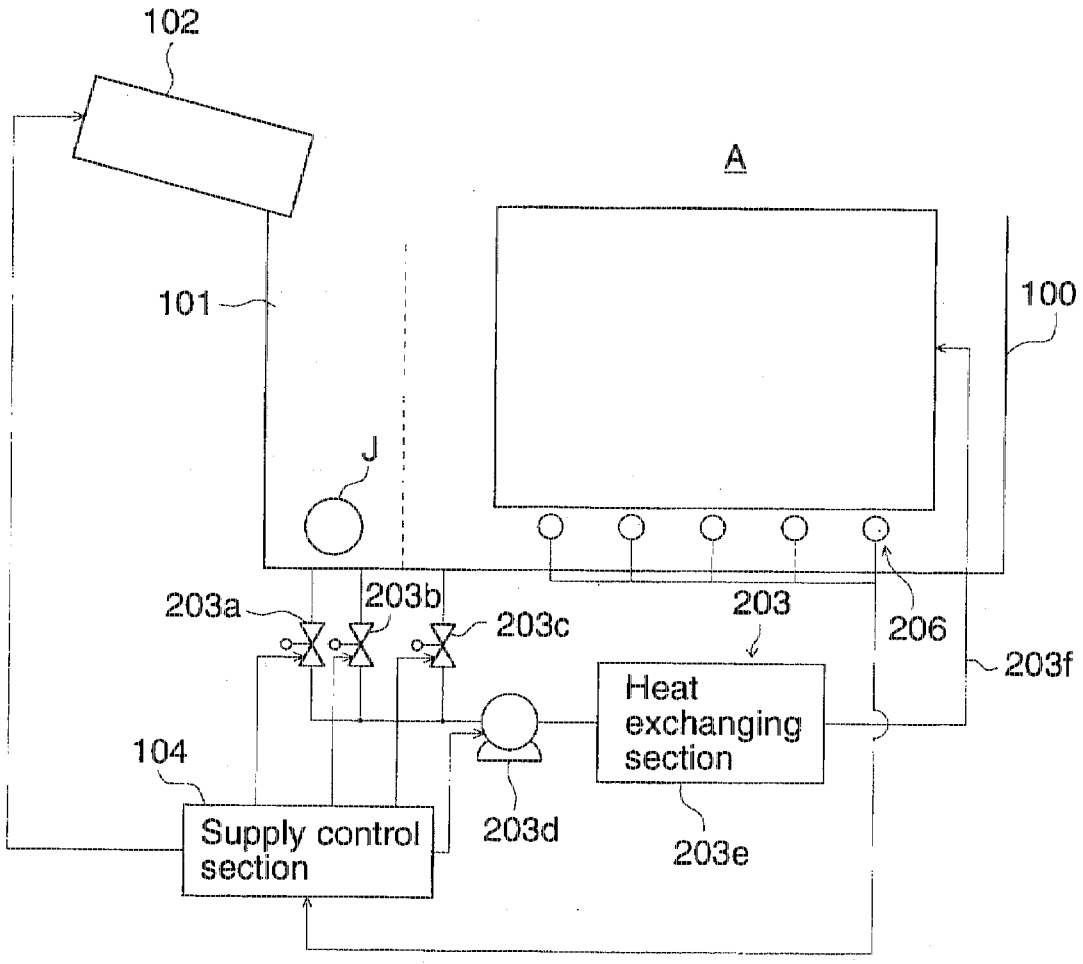
FIG. 7 is a structural diagram of still another concrete example of a processing apparatus for light-sensitive materials.
Figure 8:
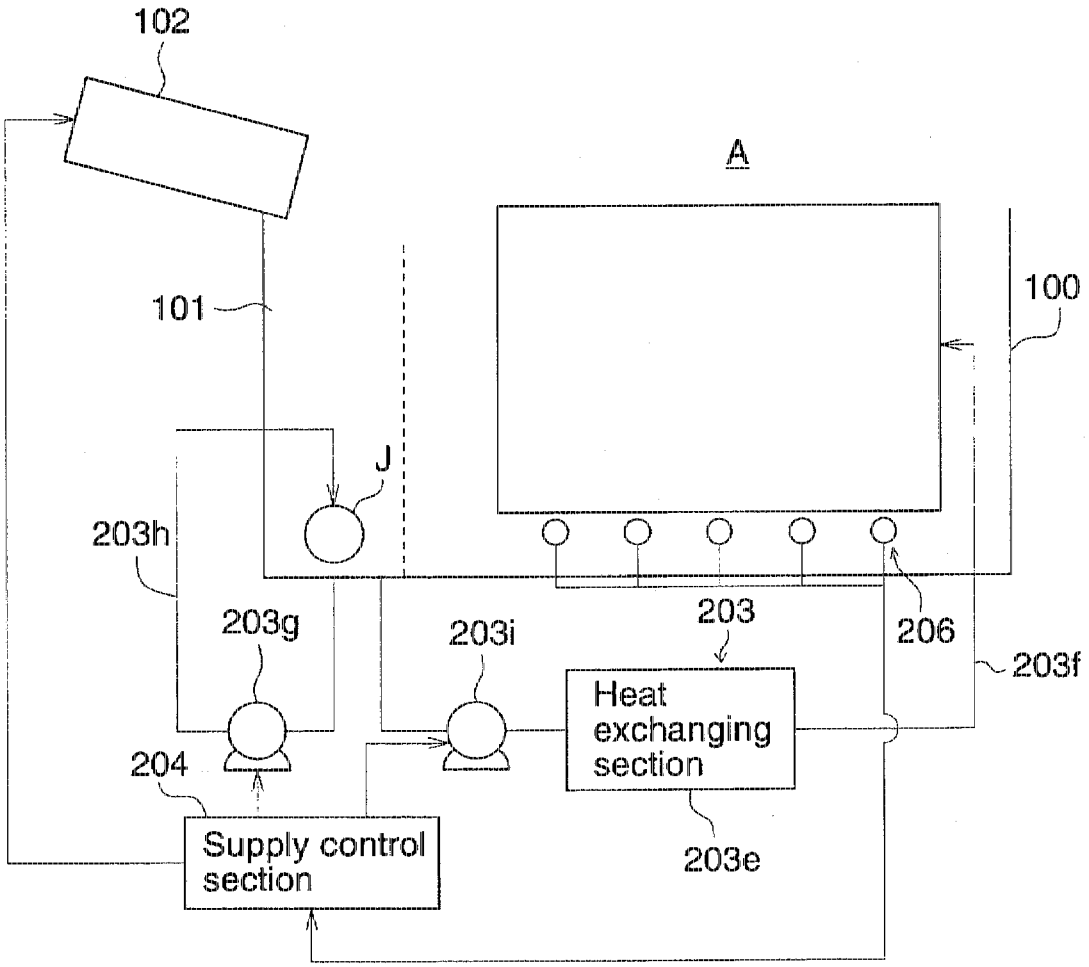
FIG. 8 is a structural diagram of a further concrete example of a processing apparatus for light-sensitive materials.
Figure 9:
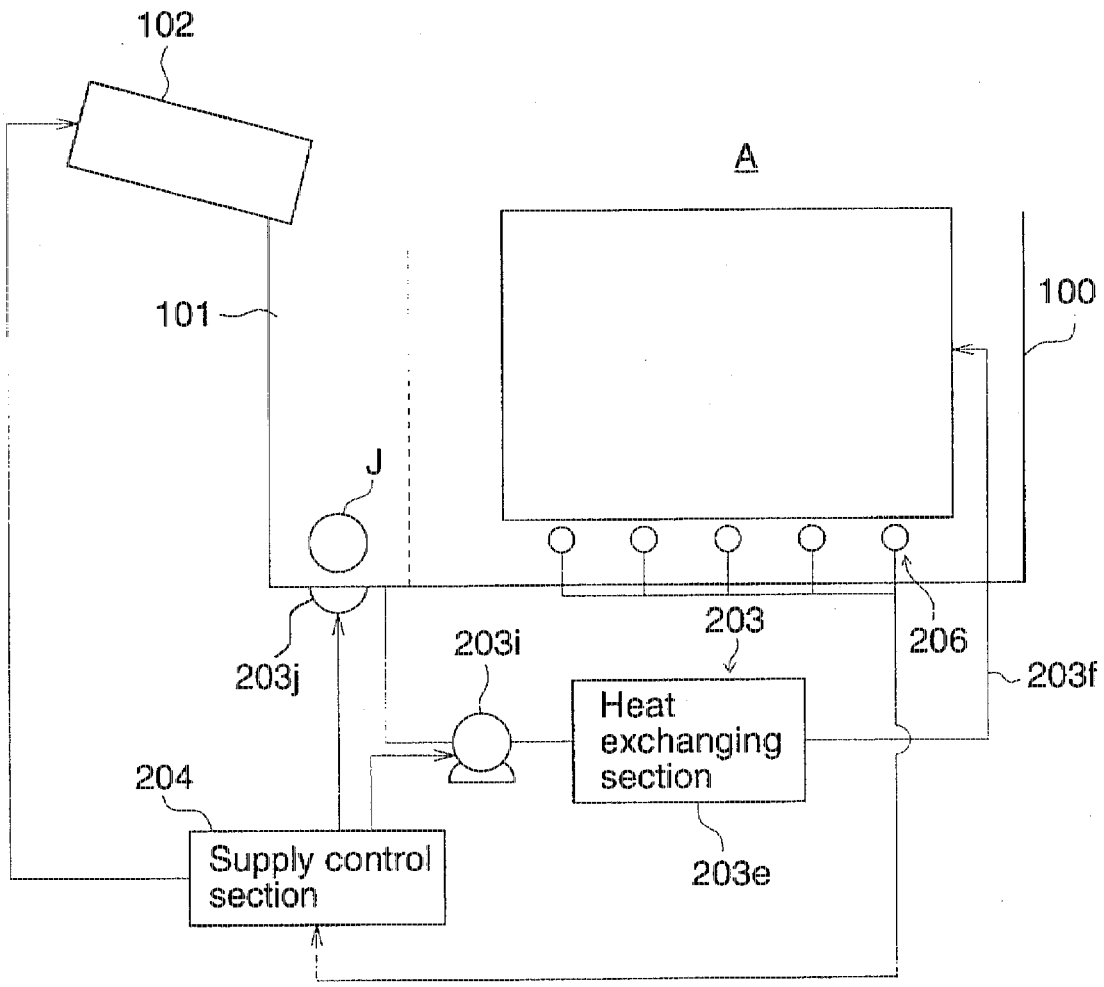
FIG. 9 is a structural diagram of one more concrete example of a processing apparatus for light-sensitive materials.

Concrete examples of the compulsory dissolution means 203 are shown in FIGS. 7 through 9. On the processing apparatus for light-sensitive materials A, there are provided plural density sensors 206 in the direction perpendicular to the conveyance direction of a light-sensitive material in processing tank 100, and density information are sent from the density sensors 206 to the dissolution control section 204 where the dissolving speed of solid processing agent J is controlled through the compulsory dissolution means 203 based on density information.

Since a monochromatic printing plate and an X-ray film are large in size, compared with films and photographic papers handled in photofinishing laboratories, they have enough lengths in the direction in which they are conveyed and the direction perpendicular to the former direction. Therefore, concentration and activity of a processing solution need to be uniform. In particular, when stabilizing concentration of a processing solution while dissolving solid processing agent J differently from the conventional method, a plurality of concentration sensors 206 are provided in the lateral direction of processing tanks and concentration information from these concentration sensors are used to drive compulsory dissolving means 203 for controlling the dissolving speed of solid processing agent J, thus, concentration irregularity of a processing solution in the lateral direction of a processing tank can be eliminated.

The compulsory dissolving means 203 is composed of valves 203*a*–203*c*, circulation pump 203*d*, heat exchanger 203*e* and circulation pipe 203*f*, and the valves 203*a* and 203*b* are communicated with dissolving tank 101, while the valve 203*c* is communicated with processing tank 200. In the case of the situation where the number of light-sensitive materials to be processed is large, the valves 203*a* and 203*b* are opened and the valve 203*c* is closed to drive the circulation pump 203*d* and the heat exchanger 203*e* so that a processing solution is circulated. In the case of the situation where the number of light-sensitive materials to be processed is medium, on the other hand, the valve 203*a* is opened, the valve 203*b* is closed and the valve 203*c* is closed so that a processing solution may be circulated by the power which is a half of that needed in the preceeding case. Further, in the case of the situation where the number of light-sensitive materials to be processed is small, the valves 203*a* and 203*b* are closed and the valve 203*c* is opened to circulate in processing tank 100 so that a processing solution is circulated depending on the situation of processing for controlling dissolving speed of solid processing agent J.

Processing apparatus for light-sensitive materials A shown in FIG. 8 is composed of circulation pump 203*g* with which compulsory dissolving means 203 circulates a processing solution in dissolving tank 101, circulation pipe 203*h*, circulation pump 203*i* which circulates a processing solution in both dissolving tank 101 and processing tank 100, heat exchanger 203*e* and circulation pipe 203*f*. In the case of the situation where the number of light-sensitive materials to be processed is large, both circulation pump 203*g* and circulation pump 203*i* are driven to circulate a processing solution. In the case of the situation where the number of light-sensitive materials to be processed is medium, on the other hand, circulation pump 203*g* is driven and driving of circulation pump 203*i* is stopped to circulate a processing solution. Further, in the case of the situation where the number of light-sensitive materials to be processed is small, driving of both circulation pump 203*g* and circulation pump 203*i* is stopped so that a processing solution is circulated depending on the situation of processing for controlling dissolving speed of solid processing agent J.

Further, in processing apparatus for light-sensitive materials A shown in FIG. 9, compulsory dissolving means 203 is composed of piezoelectric transducer j provided on the bottom of dissolving tank 101, circulation pump 203*i* which circulates a processing solution in dissolving tank 101 and processing tank 100, heat exchanger 203*e* and circulation pipe 203*f*. The circulation pump 203*i* is driven to circulate a processing solution, and when the number of light-sensitive materials to be processed is large, input voltage for the piezoelectric transducer 203*j* is enhanced for circulation of a processing solution so that a processing solution is circulated depending on the situation of processing for controlling dissolving speed of solid processing agent J.

Figure 10:
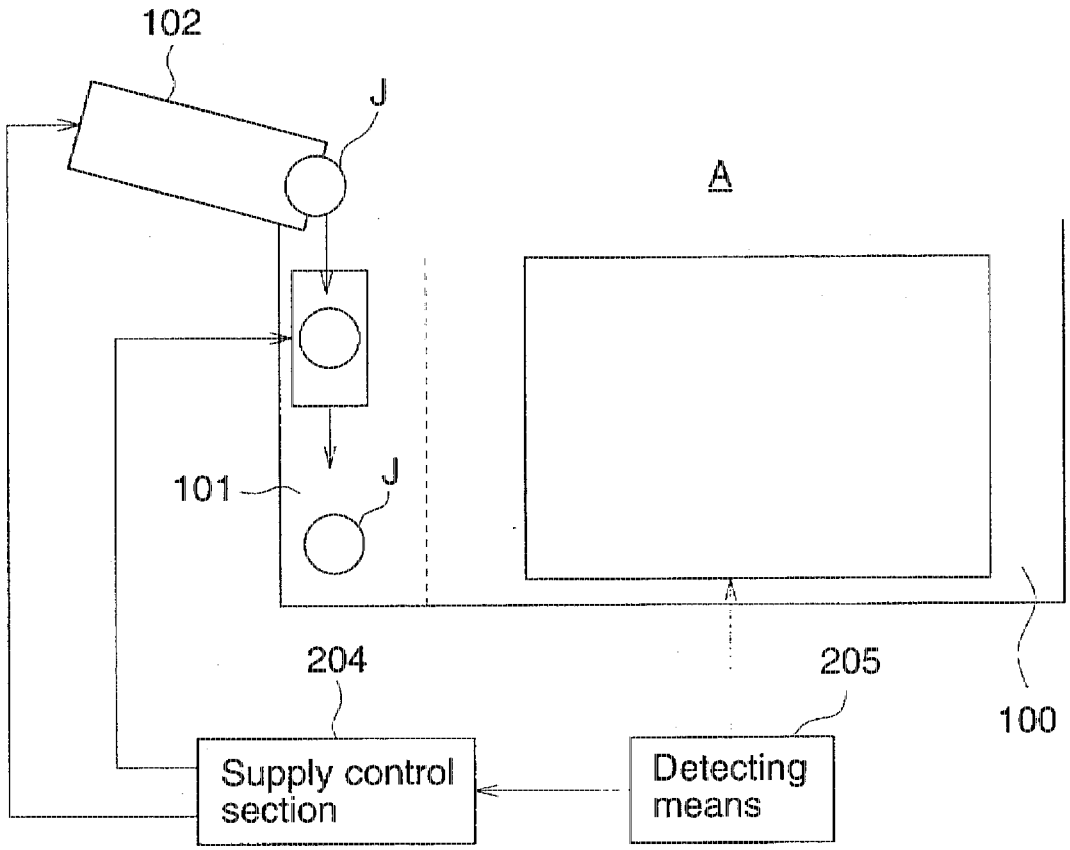
FIG. 10 is a structural diagram of an additional concrete example of a processing apparatus for light-sensitive materials.

Further, in processing apparatus for light-sensitive materials A shown in FIG. 10, compulsory dissolving means 203 changes the surface area of solid processing agent J supplied to dissolving tank 101. This compulsory dissolving means 203 applies pressure on solid processing agent J to make its form powder-shaped, or to cut, or to make holes with needles for changing the surface area, thereby controlling dissolving speed of solid processing agent J.

Figure 11:
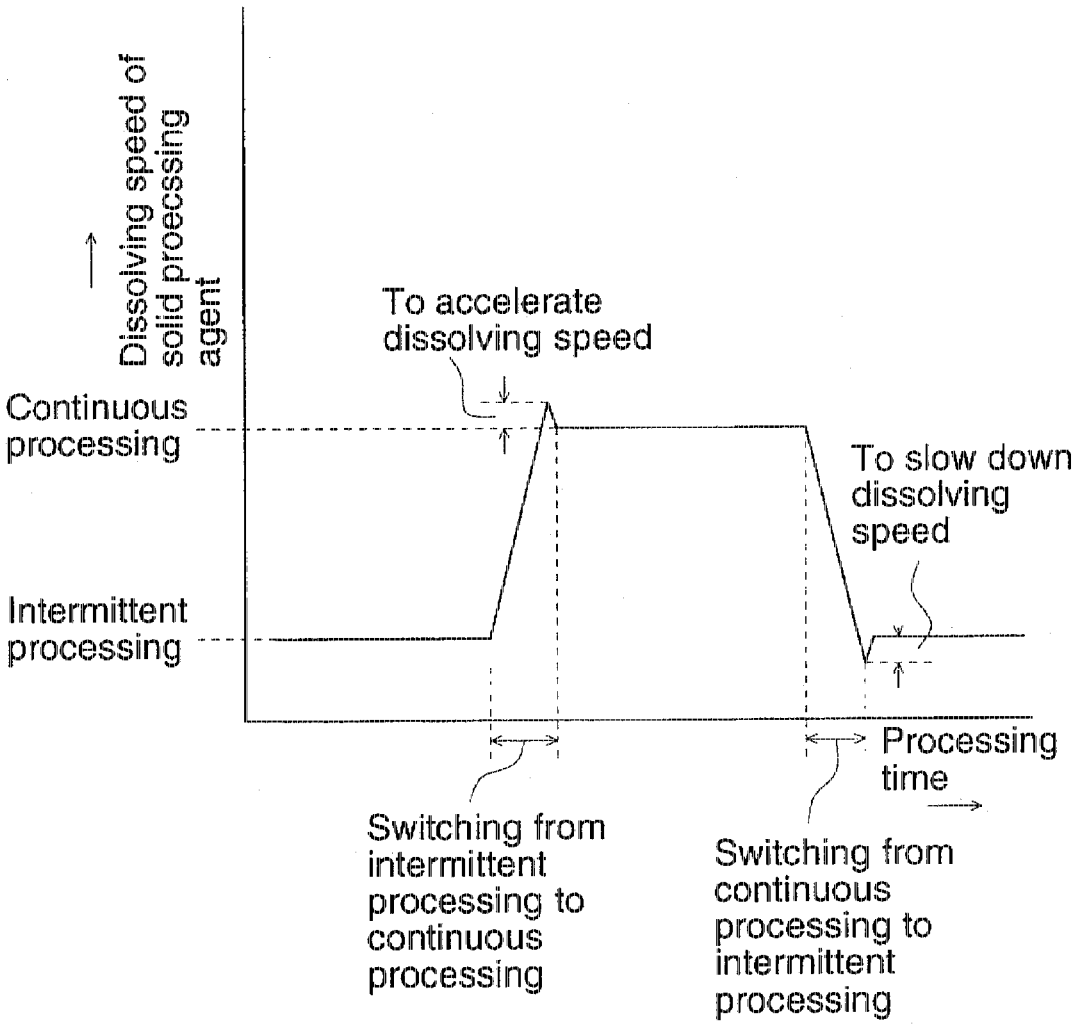
FIG. 11 is a structural diagram of an example of dissolving speed control for another solid processing agent in a processing apparatus for light-sensitive materials.

As shown in FIG. 11, processing apparatus for light-sensitive materials A provides both intermittent processing and continuous processing as a processing condition for light-sensitive materials, wherein dissolving speed of solid processing agent J for intermittent processing is low and that for continuous processing is high. In addition, the dissolving speed of solid processing agent J in the course of switching from intermittent processing to continuous processing is made to be higher than the dissolving speed in continuous processing, while, the dissolving speed of solid processing agent J in the course of switching from continuous processing to intermittent processing is made to be lower than the dissolving speed in intermittent processing, thereby concentration of a processing solution is stabilized by improving a response in the course of switching.

Figure 12:
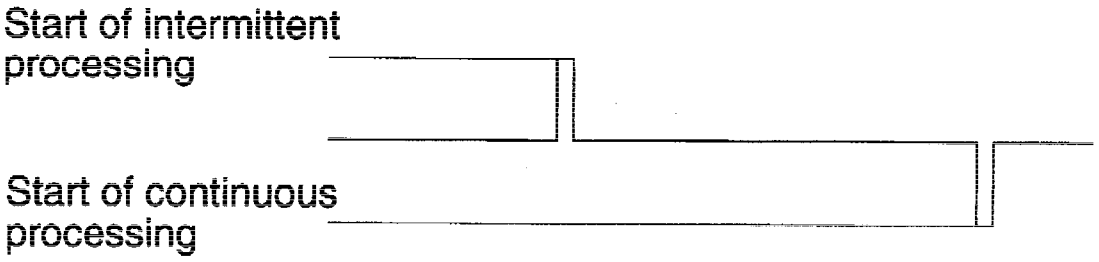
FIGS. 12(*a*) and 12(*b*) is a structural diagram of an example of dissolving speed control for other solid processing agent in a processing apparatus for light-sensitive materials.
Figure 12:
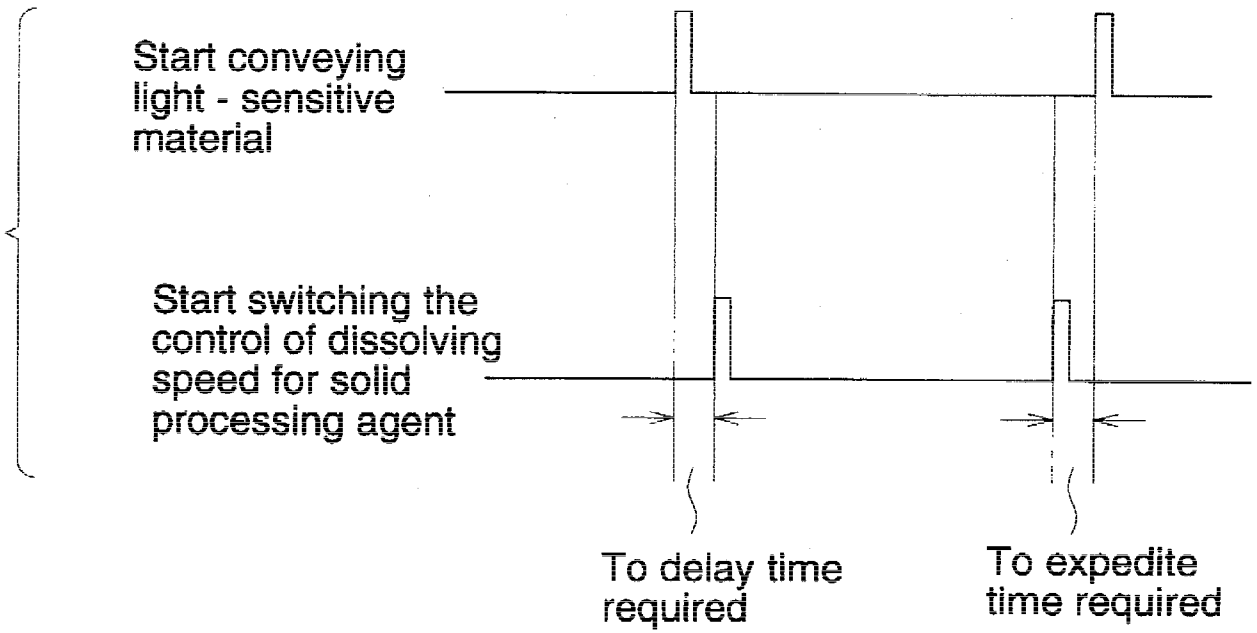

As shown in FIGS. 12(*a*) and 12(*b*) in processing apparatus for light-sensitive materials A, dissolving speed of solid processing agent J for intermittent processing is made to be low and that for continuous processing is made to be high, and further, the start of dissolving speed control for solid processing agent J in the course of switching from intermittent processing to continuous processing is made earlier by a predetermined time period than the start of conveyance of a light-sensitive material, and, on the other hand, the start of dissolving speed control for solid processing agent J in the course of switching from continuous processing to intermittent processing is made later by a predetermined time period than the start of conveyance of a light-sensitive material, thereby concentration of a processing solution is stabilized by improving a response in the course of switching. A method wherein adjustment is made only in the case of switching from intermittent processing to continuous processing or from continuous processing to intermittent processing is also acceptable naturally.

Figure 13:
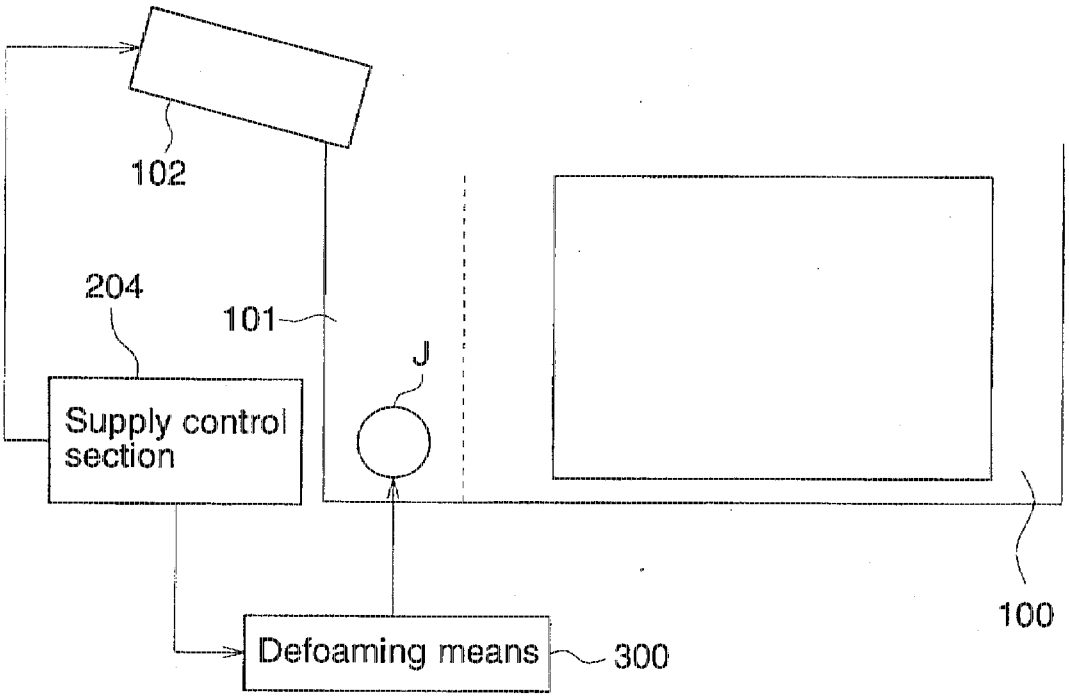
FIG. 13 is a structural diagram of another concrete example of a processing apparatus for light-sensitive materials.

The processing apparatus for light-sensitive materials in the invention is applied to developing tank 3 and fixing tank 4 both in a processing tank of the processing apparatus for light-sensitive materials A shown in FIGS. 1 and 2, and more concrete examples are shown in FIG. 13.

Processing apparatus for light-sensitive materials A is structured in the same manner as in those shown in the aforesaid FIGS. 3–12, and dissolving tank 101 is provided with foam preventing means 300 that prevents generation of foam. Those constituting this foam preventing means 300 include a supersonic wave generating means that generates supersonic waves, a low frequency generating means that generates low frequency, or antifoaming agents mixed in solid processing agent J.

As a supersonic wave generating means that generates supersonic waves or a low frequency generating means that generates low frequency, it is possible to use supersonic wave generators or low frequency generators which are available on the market, and they are affixed on the bottom or the side wall of dissolving tank 101. The foam preventing means 300 can be represented by an antifoaming agent mixed in solid processing agent J in advance, and this antifoaming agent is used by changing a component ratio depending on the kind of a processing solution or changing distribution of an antifoaming agent component in a tablet of solid processing agent J.

For example, since light-sensitive materials such as a monochromatic printing plate and an X-ray film are large in size, compared with films handled in photofinishing laboratories, it is necessary to increase an amount of solid processing agent J to be supplied or to increase the dissolving speed of the solid processing agent J.

When a supply amount of solid processing agent J is increased or the dissolving speed of the solid processing agent J is increased, there is a risk that foam may tend to be generated to deteriorate uniformity of a processing solution causing uneven processing and lowered dissolving speed, resulting in deteriorated quality compared with a conventional concentrated solution system. Accordingly, the foam preventing means 300 is used to prevent generation of foam and thereby to accelerate dissolution.

Figure 14:
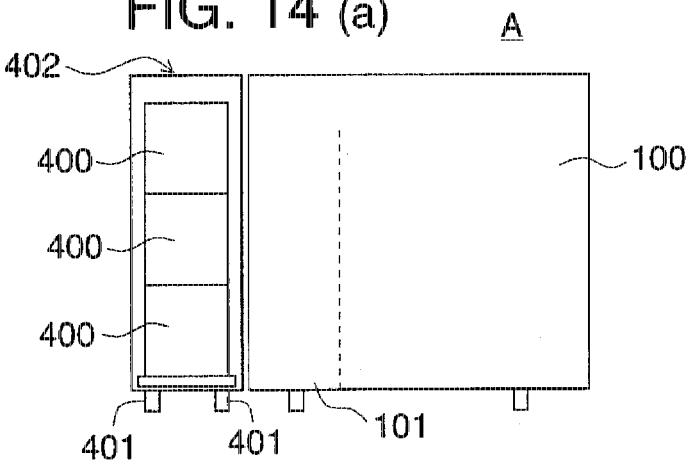
FIGS. 14(*a*)–(*d*) are structural diagrams of still another concrete example of a processing apparatus for light-sensitive materials.
Figure 14:
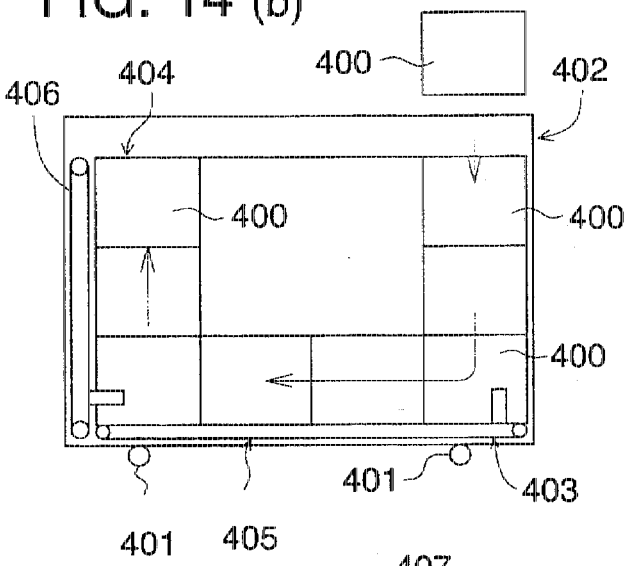
Figure 14:
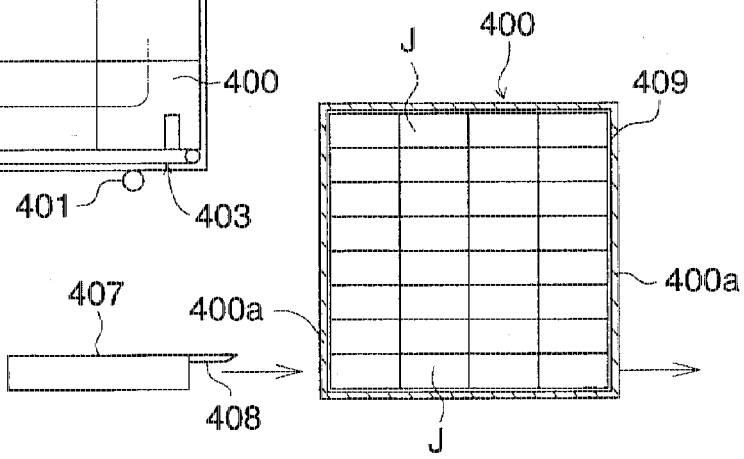
Figure 14:
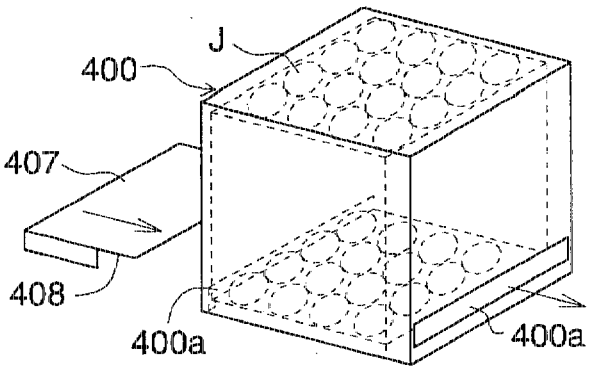

The processing apparatus for light-sensitive materials in the invention is applied to developing tank 3 and fixing tank 4 both in a processing tank of the processing apparatus for light-sensitive materials A shown in FIGS. 1 and 2, and more concrete examples are shown in FIGS. 14(*a*)–14(*d*).

The processing apparatus for light-sensitive materials A is provided with replenishing unit 402 having thereon caster 401. Though the replenishing unit 402 is shown to be portable, a replenishing unit that is affixed on the side of the processing apparatus for light-sensitive materials A or the one which can be installed on or removed from the processing apparatus may also be acceptable.

Cartridge 400 accommodating a plurality of solid processing agents J is set on the replenishing unit 402. For preparing a processing solution and maintaining its concentration for processing on the processing apparatus for light-sensitive materials A, it is necessary to dissolve solid processing agents J weighing 3–6 kg per day, for example. Therefore, the replenishing unit 402 is mounted on the side of the processing apparatus for light-sensitive materials A fixedly or in a detachable manner so that considerable amount of solid processing agents J can be conveyed, loaded and supplied to a dissolving tank. Loading of solid processing agent J to the replenishing unit 402 is of a cartridge type, and cartridge 400 accommodating solid processing agent J is set on the replenishing unit 402 which is provided with casters 401 and thereby is transported easily even by a woman.

The replenishing unit 402 is provided with moving means 403 that moves cartridge 400 to a prescribed supply position and with supply means 404 that supplies a plurality of solid processing agents J in the cartridge 400 that is set to the supply position to dissolving tank 101. As shown in FIG. 14(*b*), the moving means 403 is provided with belt conveyance means 405 that moves the set cartridge 400 to the position where the cartridge is elevated and elevator 406 that elevates the cartridge 400 moved to the position where the cartridge is elevated.

The supply means 404 is provided, as shown in FIGS. 14(*c*) and (*d*), with thrusting plate 407 which is further provided thereon with cutter 408. On the lower portion of the cartridge 400, there are arranged perforated openings 400*a* in symmetrical positions. When the cartridge 400 is suspended at a prescribed position after being elevated by elevator 406, the thrusting plate 407 operates to tear the opening 400*a* of the cartridge 400 and to tear simultaneously a sack sealing the cartridge 400, thus internal solid processing agents J in a bottom layer are moved in parallel to be dropped in dissolving tank 101.

Figure 15:
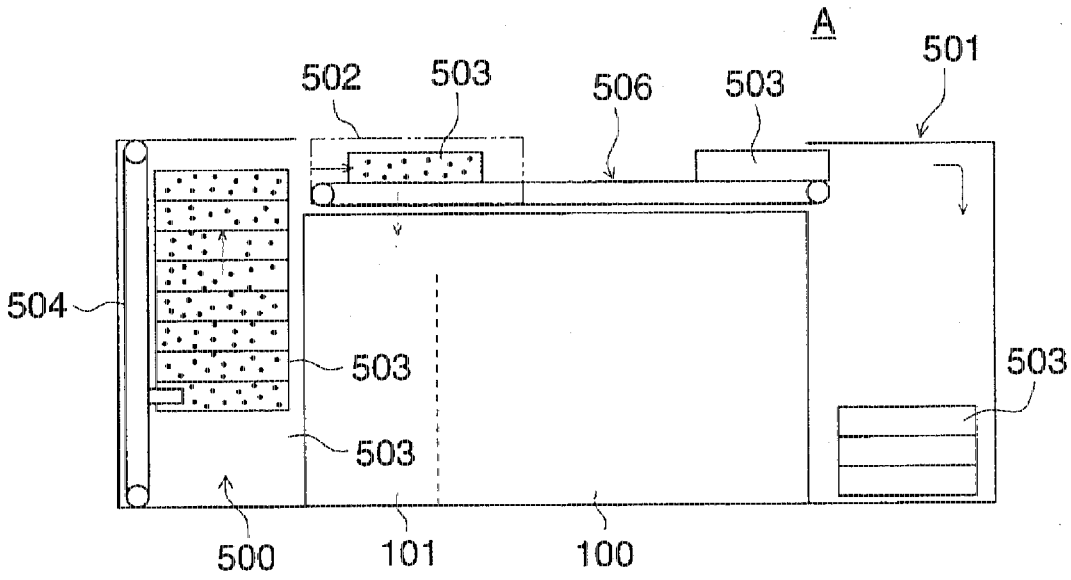
FIGS. 15(*a*) and 15(*b*) are structural diagrams of a further concrete example of a processing apparatus for light-sensitive materials.
Figure 15:
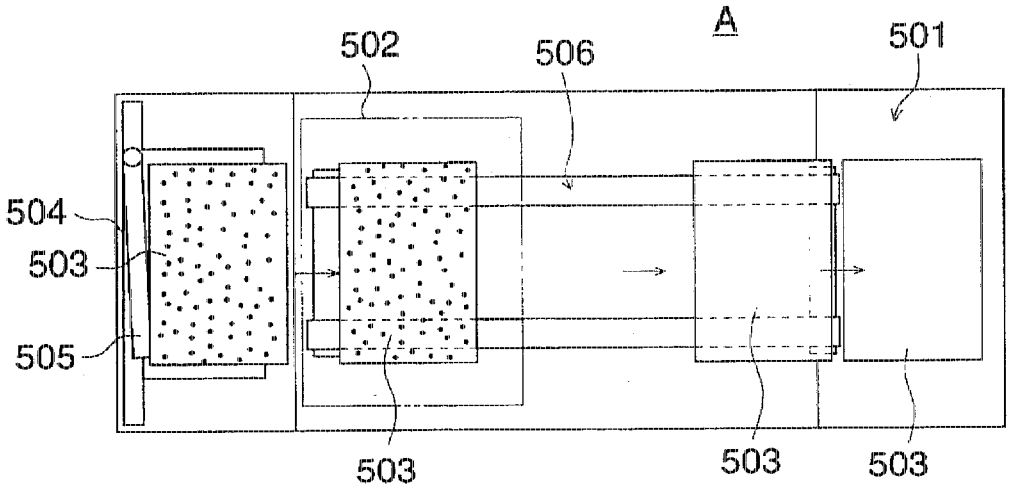
Figure 16:
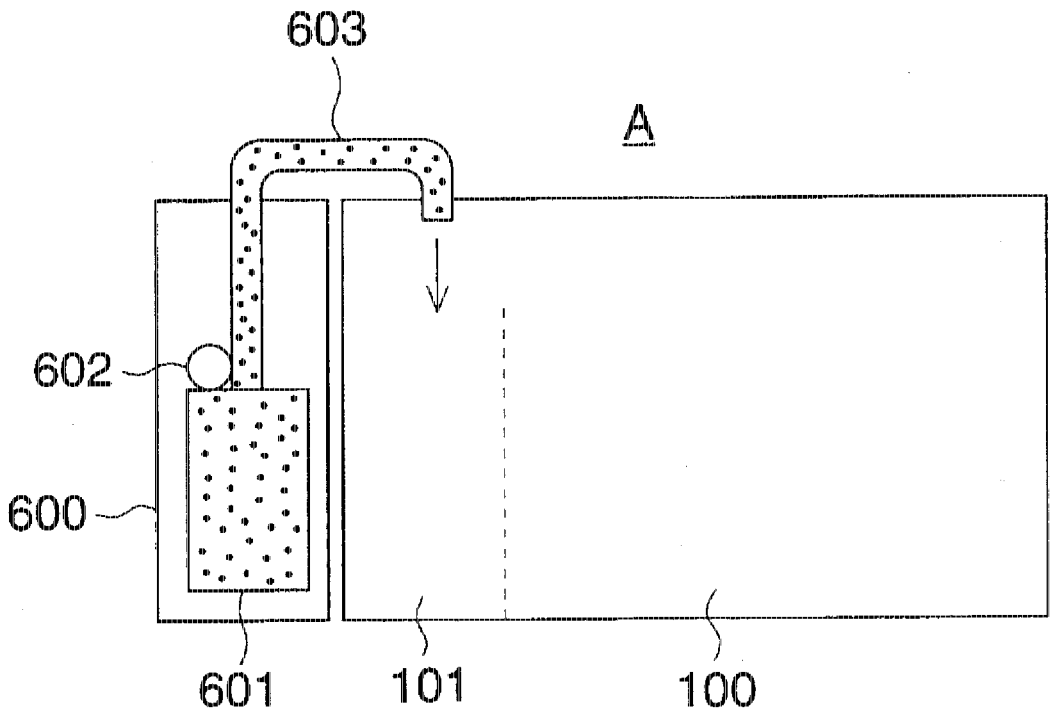
FIG. 16 is a structural diagram of one more concrete example of a processing apparatus for light-sensitive materials.

The processing apparatus for light-sensitive materials in the invention is applied to developing tank 3 and fixing tank 4 both in a processing tank of the processing apparatus for light-sensitive materials A shown in FIGS. 1 and 2, and more concrete examples are shown in FIGS. 15(*a*) and 15(*b*).

Replenishing unit 500 is arranged on one side of the processing apparatus for light-sensitive materials A, while collecting unit 501 is arranged on the other side thereof, and solid processing agent supply section 502 is arranged on the top plate of the processing apparatus for light-sensitive materials A. On the replenishing unit 500, there is set cartridge 503 accommodating a plurality of solid processing agents J and this cartridge 503 is moved to the upper position by elevating means 504. This cartridge 503 is sent by thrusting lever 505 on belt conveyance means 506 arranged on the top plate. The belt conveyance means 506 sends cartridge 503 to solid processing agent supply section 502 arranged on the top plate to take in plural solid processing agents J which are supplied to a dissolving tank by solid processing agent supply section 502. The cartridge 503 from which a plurality of solid processing agents J have been taken out is collected to the collecting unit 501 by belt conveyance means 506.

On the processing apparatus for light-sensitive materials A, solid processing agent J is replenished from the upper side of the top plate through a drop system. Even in this case, considerable amount of solid processing agents J are supplied. Therefore, when arranging only on the top plate, there is a risk that the top plate is deformed by the weight. So, installation of solid processing agent J is on the side wall by replenishing unit 500 wherein solid processing agent J is elevated and then is dropped. In this case, it is preferable that solid processing agent J is elevated little by little because it is dangerous to elevate all of them on the top plate at a time.

On the processing apparatus for light-sensitive materials A, there is arranged replenishing unit 600 on one side of the processing apparatus, and cartridge 601 accommodating solid processing agent J is set on the replenishing unit 600. Solid processing agent J in cartridge 601 is sent through conveyance pipe 603 by a driven pump that is represented by pressurizing means 602, so that solid processing agent J is supplied directly to a dissolving tank. It is also acceptable that solid processing agent J is sent through conveyance pipe 603 and then is taken into a solid processing agent supply section that is arranged on the top plate covering the upper part of processing tanks. Even when the solid processing agent J is not solid but is granule or paste, for example, they can be sent by a pump which is pressurizing means 602.

Figure 17:
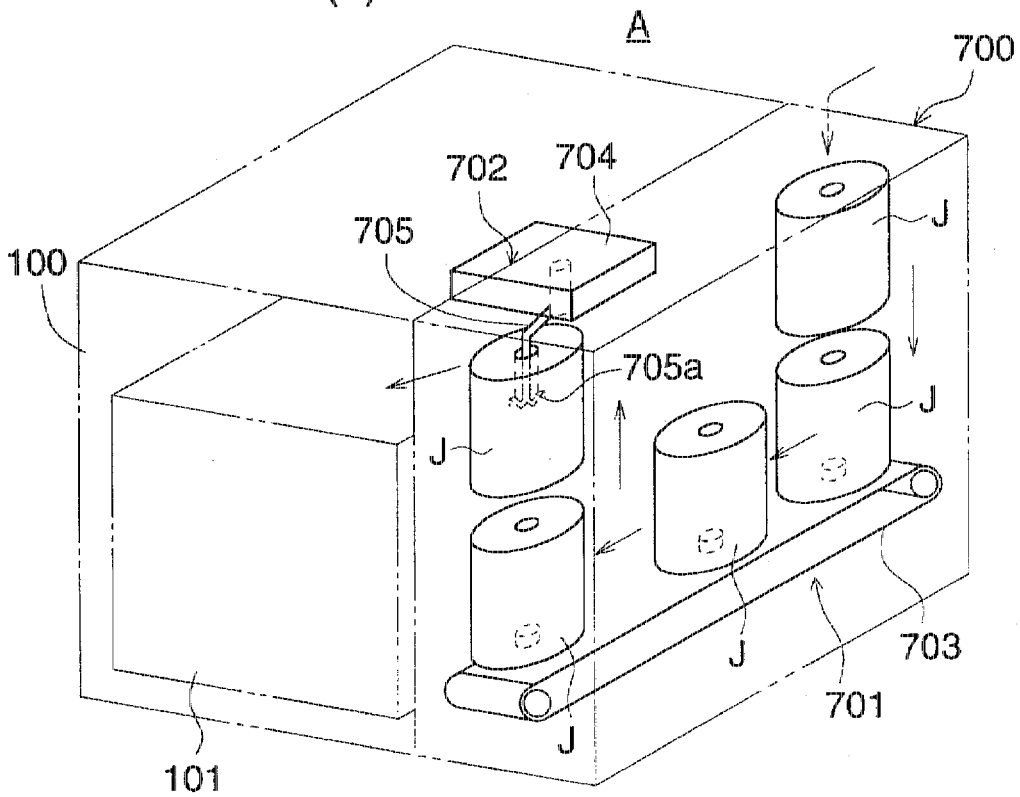
FIGS. 17(*a*) and 17(*b*) are structural diagrams of an additional concrete example of a processing apparatus for light-sensitive materials.
Figure 17:
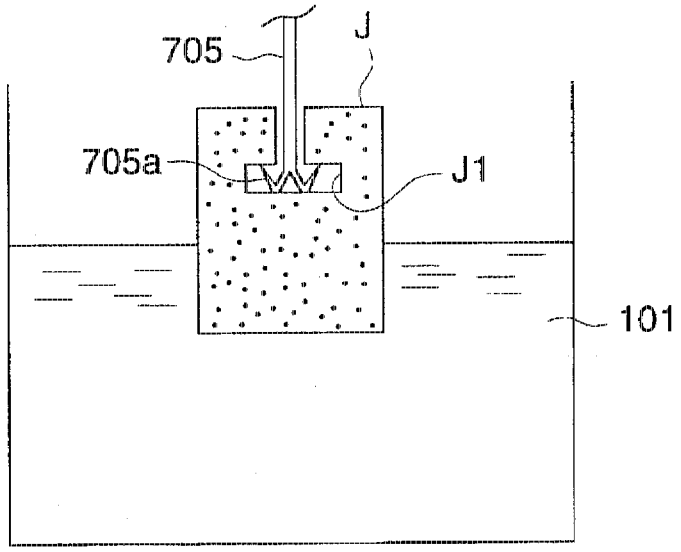

The processing apparatus for light-sensitive materials in the invention is applied to developing tank 3 and fixing tank 4 both in a processing tank of the processing apparatus for light-sensitive materials A shown in FIGS. 1 and 2, and more concrete examples are shown in FIG. 17(*a*) and 17(*b*).

On the processing apparatus for light-sensitive materials A, there is arranged replenishing unit 700 on one side thereof, and block-shaped solid processing agent J is set on the replenishing unit 700. For example, cylindrical and block-shaped solid processing agent J having a radius of 8 cm and a height of 20 cm is used. Replenishing unit 700 is provided with moving means 701 that moves the block-shaped solid processing agent J to a predetermined supply position and with supply means 702 that supplies the block-shaped solid processing agent J set to the supply position to dissolving tank 101. The moving means 701 is equipped with belt 703 and moves the block-shaped solid processing agent J. In the supply means 702, elevating section 704 moves arm 705 up and down to lift and swing horizontally the block-shaped solid processing agent J to supply it to the dissolving tank 101 with hook 705*a* of the arm 705 engaged with center hole J1 of the block-shaped solid processing agent J. It is also acceptable that the block-shaped solid processing agent J is a thin cylindrical one and 4 or 5 pieces thereof are dipped gradually in a solution to control an amount of dissolution.

Block-shaped solid processing agent J may be put in dissolving tank 101 gradually as shown in FIG. 17(*b*), or it may be put in totally at a time. Using block-shaped solid processing agent J weighing 1–10 kg, for example, is effective for the large volume processing, because it requires less mechanical operations and thereby generates less troubles and noises, compared with an occasion wherein a small amount is supplied frequently to be dissolved. In addition, dissolution starts on the surface and advances to the inside, and dissolving speed is controlled by adjustment of water flow or by stirring. As an example of a stirring means, dissolving speed can be controlled by regulating the number of rotations of a brush-like stirring member.

Figure 18:
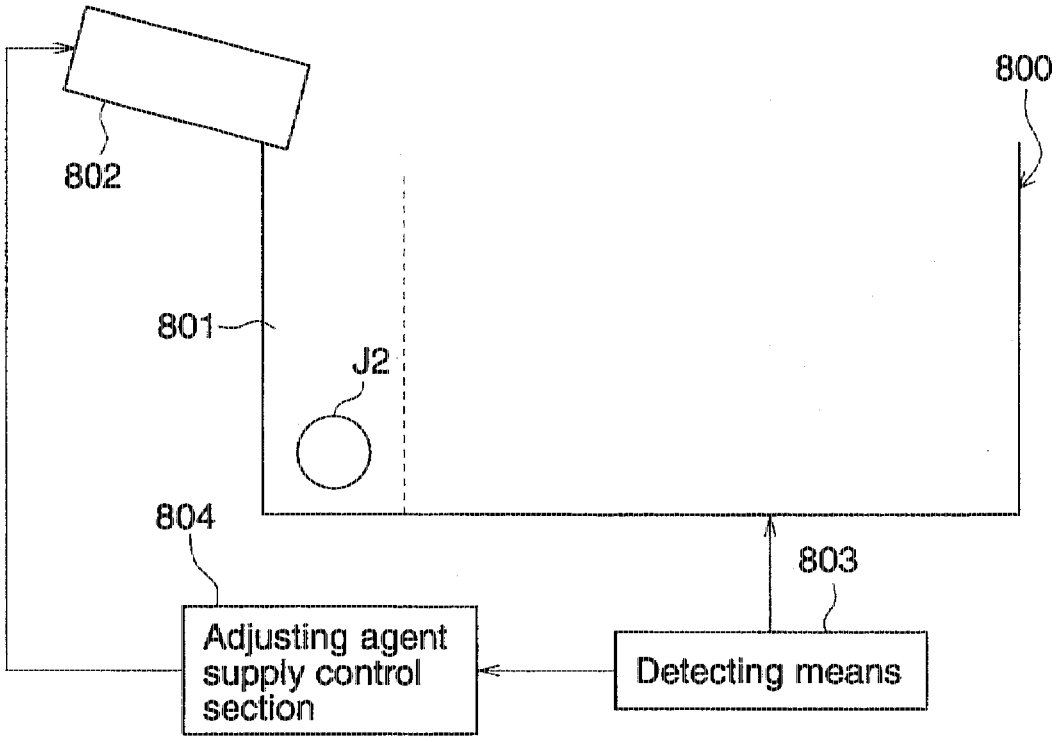
FIG. 18 is a structural diagram of yet a further concrete example of a processing apparatus for light-sensitive materials.

The processing apparatus for light-sensitive materials in the invention is applied to washing tank 5 in a processing tank of the processing apparatus for light-sensitive materials A shown in FIGS. 1 and 2, and a more concrete example is shown in FIG. 18.

Processing apparatus for light-sensitive materials A is equipped with processing tank 100 containing a processing solution for processing light-sensitive materials, FIG. 18 shows a detailed example of a washing tank 800 and associated pH control means. As shown in FIG. 18, tank 800 contains washing water to wash processed light-sensitive materials. Dissolving tank 801 communicates with the washing tank 800 to dissolve alkali solid adjusting agent J2 supplied, alkali solid adjusting agent supply section 802 that supplies alkali solid adjusting agent J2 to the dissolving tank 801, detecting means 803 that detects The pH value of washing water, and adjusting agent supply and control section 804 that controls an amount of supply of alkali solid adjusting agent J2 in accordance with the detection.

In the processing tank 100 containing a processing solution for processing light-sensitive materials, developing and fixing are carried out, while in the washing tank 800, components of a fixer which are contained in the light-sensitive materials or are stuck thereto are rinsed out and washed out. However, it is impossible to wash out completely in the washing tank 800, and a trace of components of a fixer remaining in the light-sensitive materials are carried over to s squeezing section. Thereupon, components of a fixer carried over to squeezing section are transferred to a squeezing roller and accumulated thereon to be increased in terms of concentration, thus they are transferred again onto the light-sensitive material squeezed at the squeezing section, causing unevenness and troubles of image quality.

In the past, therefore, a squeezing roller in the squeezing section has been rinsed out again, or a contact angle of a roller has been adjusted so that components of a fixer are hardly transferred, which, nevertheless, was not perfect. Supply of alkali solid adjusting agent J2, however, can neutralize components of a fixer and thereby to enhance ability of cleaning light-sensitive materials.

Alkali solid adjusting agent J2 can be prepared by tableting sodium citrate, sodium bicarbonate, or sodium carbonate, for example.

Figure 19:
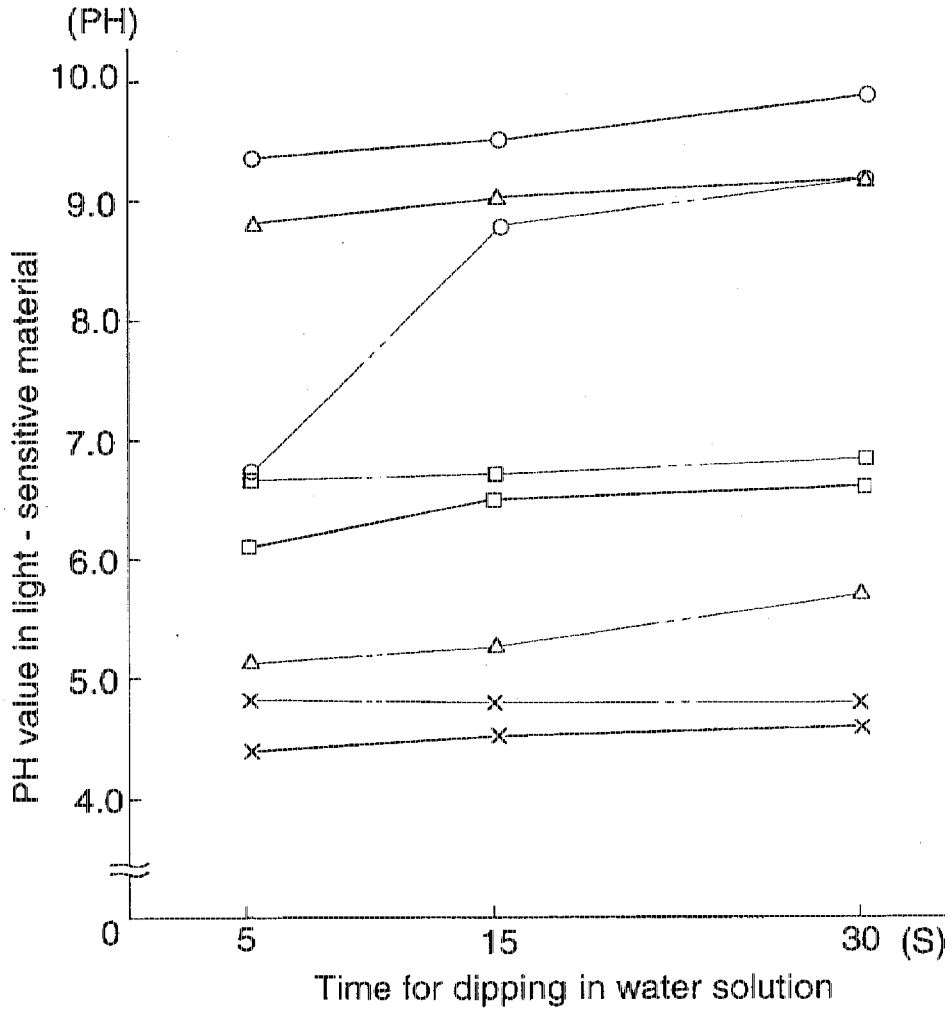
FIG. 19 is a diagram (A chart and a graph) showing PH values of light-sensitive materials dipped in a 2% aqueous alkali solution for various periods of manual washing time.

PH values of light-sensitive materials dipped in a 2% aqueous alkali solution for various periods of manual washing time are shown in FIG. 19. By using sodium citrate as alkali solid adjusting agent J2, it is possible to neutralize components of a fixer stably even in the case of different light-sensitive materials, and thereby to enhance ability of cleaning light-sensitive materials.

As stated above, in the invention, it is possible to stabilize concentration of a processing solution by controlling an amount of solid processing agents to be supplied per a unit time period depending on an amount of light-sensitive materials processed per a unit time period.

In the invention, it is possible to stabilize concentration of a processing solution by controlling dissolving speed of solid processing agents depending on an amount of light-sensitive materials processed per a unit time period, because natural dissolution can not cause concentration of a processing solution to be stabilized when dissolving a large amount of solid processing agents.

In the invention, it is possible to improve uniformity of a processing solution, thereby to prevent unevenness of processing, and to improve dissolving speed, when occurrence of foam caused in a dissolving tank by dissolution of solid processing agents is prevented.

In the invention, even when a large amount of light-sensitive materials are processed, it is possible to stabilize concentration of a processing solution by enabling a large amount of solid processing agents to be supplied.

In the invention, it is possible to stabilize the alkaline degree of washing water by dissolving alkali solid adjusting agents.

Next, there will be explained an example wherein a concentration distribution adjusting means of the invention is applied to processing apparatuses shown in FIGS. 1 and 2.

In the present example, a form of jetting out for circulation in a developing tank, the number of jetting outlets, positions thereof and jetting direction were improved to be used.

Figure 22:
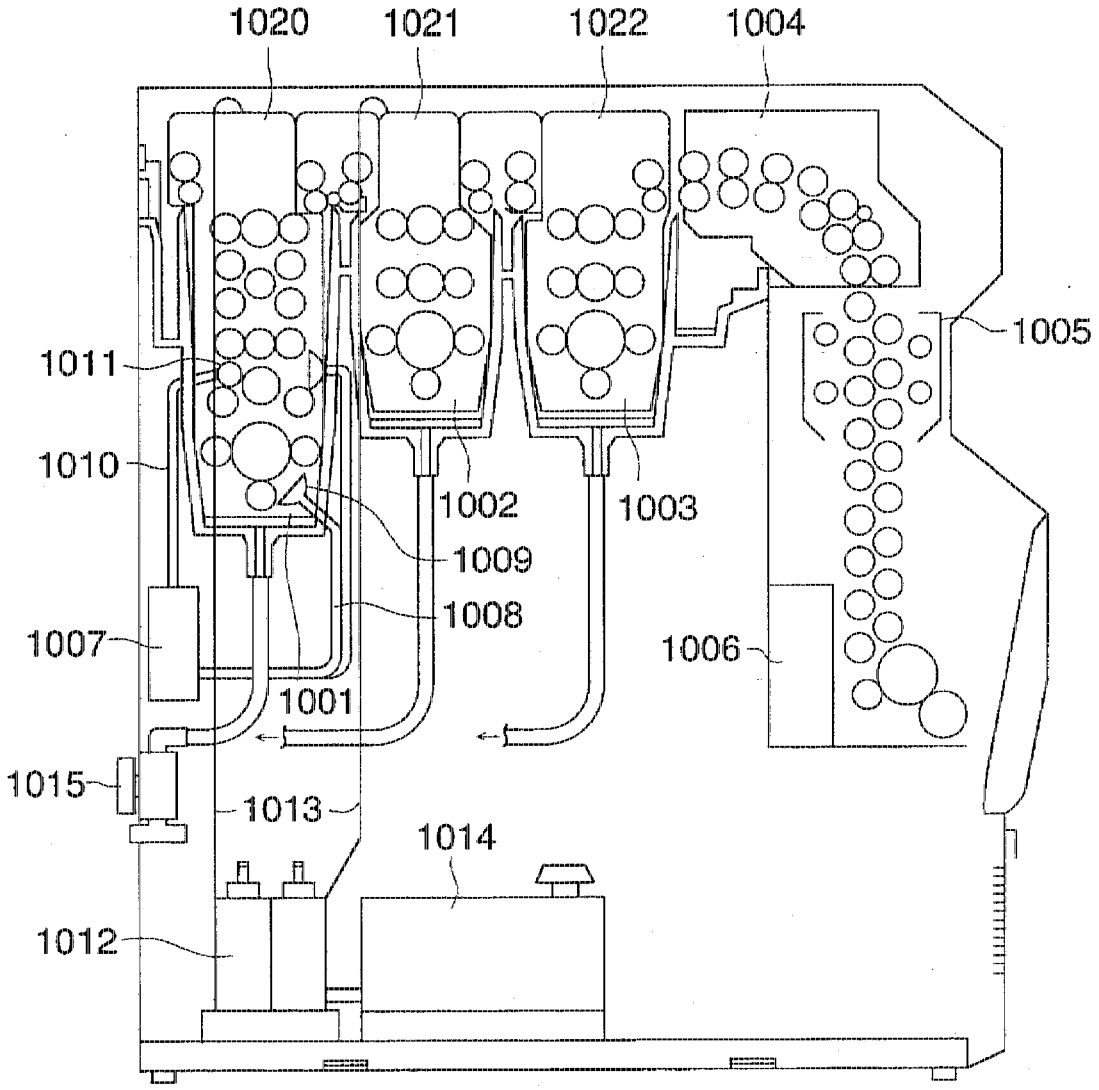
FIG. 22 is a cross-section of an automatic processing machine having a plurality of jetting outlets for circulation.
Figure 24:
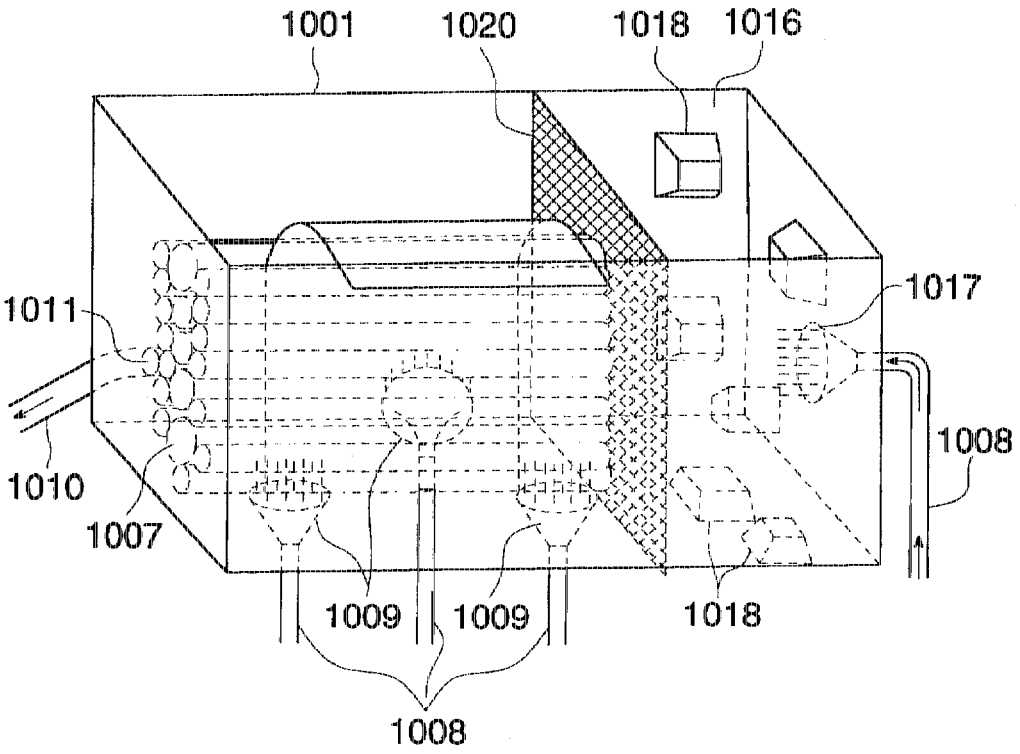
FIG. 24 is a perspective view of a processing tank in which a dissolving tank for developing tablets and a developing tank are separated each other by a mesh, and a plurality of jetting outlets for circulation are provided.

FIG. 22 represents a cross-section of an automatic processing machine having therein a plurality of jetting outlets for circulation, and FIG. 24 represents a perspective view of a processing tank wherein a dissolving tank for solid processing agents and a developing tank are separated each other by a mesh, and a plurality of jetting outlets for circulation are provided. The numeral 1001 is a developing tank, the numeral 1002 is a fixing tank, 1003 represents a washing tank, 1004 represents a squeezing section, 1005 represents a drying section, and 1006 represents a blower for drying. The numeral 1016 represents a dissolving tank for developing tablets that is separated from the developing tank 1001 by separating mesh 1020, and a developing solution sucked through sucking inlet 1011 and contained in the developing tank passes through sucking pipe 1010 for circulation and is jetted out of jetting nozzle 1009 for circulation or of dissolving tank releasing nozzle 1017 to be circulated. In the dissolving tank for developing tablets 1016, there is provided projection 1018 that accelerates dissolution. Replenishing water is replenished from replenishing water tank 1014 provided separately through replenishing water supply pipe 1013 by replenishing water supply pump 1012. Solutions exceeding a capacity of the tank are ejected out through overflow cock 1015.

Figure 23:
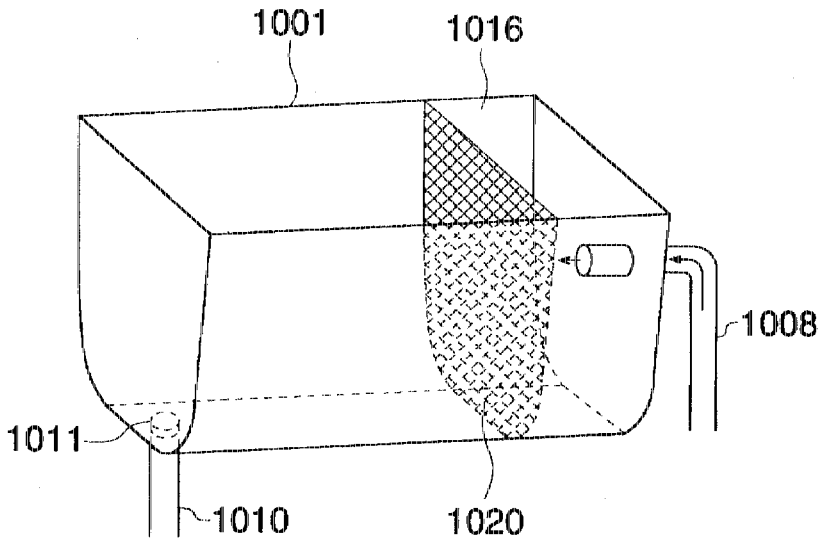
FIG. 23 PRIOR ART
FIG. 23 is a perspective view of a prior art processing tank wherein a dissolving tank for developing tablets and a developing tank are separated each other by a mesh.

FIG. 23 represents a perspective view of a processing tank wherein dissolving tank for developing tablets 1016 and developing tank 1001 are separated each other by mesh 1020, and there is shown a comparative developing tank wherein concentration inclination for developing agents shows 5% or more because of less releasing outlets in the developing tank.

In the processing step, solid processing agents equivalent to 42 ml of developing solution (developing agents A and B, 1 piece each) and 46 ml of fixing solution (2 pieces of fixing tablet C, 1 piece of fixing tablet D) per one sheet of light-sensitive material measuring 17 in.×14 in. are supplied automatically to the position for dissolution in synchronization with timing of a buzzer informing that the succeeding light-sensitive can be processed. Further, 10 ml of water was added for both developing and fixing. An amount of washing water is 2 l/min. For one piece of each processing agent, addition of water was started almost simultaneously with addition of processing agent, and water was added at constant speed for 10 minutes in proportion roughly to dissolving speed of processing agent. The flow rate of releasing for circulation for dissolution was 40 l/min.

<Measurement of uniformity of processing agents compositions in the course of development>

As stated above, there was started continuous running processing for 500 sheets from the start of development processing, and at each of the points corresponding to the numbers of sheets shown in Tables 1 and 2, five points (a, b, c, d and e) were selected at constant intervals in the lateral direction and processing solutions were sampled to be measured in terms of pH values and fixed in terms of HQ amount. The results thereof are shown in Tables 1 and 2. With regard to the HQ amounts, they are shown in the form of a relative value with the amount at a measurement point a of 100. Unevenness of development was evaluated in the following method.

<Evaluation of unevenness of development>

The light-sensitive materials measuring 17 in.×14 in. mentioned above were subjected to uniform exposure so that density of 1.0 may be obtained, and 200 sheets of them were processed continuously.

After that, the light-sensitive materials measuring 17 in.×14 in. subjected to uniform exposure so that density of 0.8 may be obtained were processed and evaluated based on the following evaluation ranks.

| Rank | Contents |
|---|---|
| 5: | No unevenness is observed at all. |
| 4: | There are some portions where slight density unevenness is observed (percentage of 1/10 in area). |
| 3: | Percentage of density unevenness is 1/3 in area, and density difference is about 0.1, which can be recognized visually. |
| 2: | Percentage of density unevenness is about 50% in area (density difference is 0.2). |
| 1: | Entire surface of the light-sensitive shows density unevenness (density difference is 0.3). |

The results of the evaluation are shown in Tables 1 and 2.

TABLE 1

<Processing of the invention>

| Number of sheets at each mesurement point | HQ density a | b | c | d | e | pH a | b | c | d | e | Development unevenness |
|---|---|---|---|---|---|---|---|---|---|---|---|
| 1 | 100 | 100 | 100 | 100 | 100 | 10.30 | 10.30 | 10.30 | 10.30 | 10.30 | 5 |
| 25 | 100 | 100 | 100 | 100 | 100 | 10.32 | 10.32 | 10.32 | 10.32 | 10.32 | 5 |
| 50 | 100 | 99 | 100 | 99 | 100 | 10.33 | 10.34 | 10.33 | 10.34 | 10.33 | 5 |
| 100 | 100 | 99 | 100 | 99 | 100 | 10.34 | 10.35 | 10.34 | 10.35 | 10.34 | 5 |
| 150 | 100 | 99 | 100 | 99 | 100 | 10.34 | 10.35 | 10.34 | 10.35 | 10.34 | 5 |
| 200 | 100 | 99 | 100 | 99 | 100 | 10.35 | 10.36 | 10.36 | 10.36 | 10.35 | 5 |
| 250 | 100 | 99 | 100 | 99 | 100 | 10.35 | 10.36 | 10.36 | 10.36 | 10.35 | 5 |
| 300 | 100 | 99 | 100 | 99 | 100 | 10.35 | 10.36 | 10.36 | 10.36 | 10.35 | 5 |
| 350 | 100 | 99 | 100 | 99 | 100 | 10.35 | 10.36 | 10.36 | 10.36 | 10.35 | 5 |
| 400 | 100 | 99 | 100 | 99 | 100 | 10.35 | 10.36 | 10.36 | 10.36 | 10.35 | 5 |
| 450 | 100 | 99 | 100 | 99 | 100 | 10.35 | 10.36 | 10.36 | 10.36 | 10.35 | 5 |
| 500 | 100 | 99 | 100 | 99 | 100 | 10.35 | 10.36 | 10.36 | 10.36 | 10.35 | 5 |

20

TABLE 2

<Comparative processing>

| Number of sheets at each mesurement point | HQ density a | b | c | d | e | pH a | b | c | d | e | Development unevenness |
|---|---|---|---|---|---|---|---|---|---|---|---|
| 1 | 100 | 100 | 100 | 100 | 100 | 10.30 | 10.30 | 10.33 | 10.30 | 10.30 | 5 |
| 25 | 100 | 100 | 101 | 102 | 103 | 10.30 | 10.31 | 10.32 | 10.33 | 10.35 | 4 |
| 50 | 100 | 100 | 101 | 103 | 105 | 10.31 | 10.32 | 10.33 | 10.37 | 10.38 | 3 |
| 100 | 100 | 100 | 102 | 105 | 107 | 10.32 | 10.33 | 10.34 | 10.37 | 10.38 | 3 |
| 150 | 100 | 100 | 102 | 105 | 107 | 10.33 | 10.33 | 10.35 | 10.37 | 10.38 | 3 |
| 200 | 100 | 100 | 102 | 105 | 107 | 10.34 | 10.35 | 10.36 | 10.38 | 10.39 | 2 |
| 250 | 100 | 100 | 102 | 105 | 107 | 10.35 | 10.36 | 10.37 | 10.39 | 10.40 | 2 |
| 300 | 100 | 100 | 102 | 105 | 107 | 10.35 | 10.36 | 10.37 | 10.39 | 10.40 | 2 |
| 350 | 100 | 100 | 102 | 105 | 107 | 10.35 | 10.36 | 10.37 | 10.39 | 10.40 | 2 |
| 400 | 100 | 100 | 102 | 105 | 107 | 10.35 | 10.36 | 10.37 | 10.39 | 10.40 | 2 |
| 450 | 100 | 100 | 102 | 105 | 107 | 10.35 | 10.36 | 10.37 | 10.39 | 10.40 | 2 |
| 500 | 100 | 100 | 102 | 105 | 107 | 10.35 | 10.36 | 10.37 | 10.39 | 10.40 | 2 |

As is apparent from the evaluation results in Tables 1 and 2, it is understood that development unevenness and fluctuation caused by processing timing can be improved by keeping the processing agent composition concentration within 5% as in the invention, and further by making the pH value to be 0.05 or less.

As a means of achievement, the following can be given.

A. Owing to a device to provide two or more circulating liquid flows in a developing tank, it was possible to accelerate dissolving speed of solid processing agents, the dissolution composition diffused faster and uniformity in a processing tank increased, and a light-sensitive material was able to be hit uniformly by a processing solution.

B. Owing to a device to provide a circulation path for exclusive use at the position for dissolution and dispensing of solid processing agents, dissolving speed was increased and uniformity was enhanced, which proved to be effective for solving the aforesaid problems.

C. Owing to a device to provide a mesh at an outlet for the circulating liquid flow, it was found that unevenness of the components for developing can be improved because it is possible to prevent that insoluble components circulate in a tank at the side of dispensing solid processing agents, in particular.

D. In was found that further improvement of uneven development and stability of processing timing can be attained by providing an outlet in the direction perpendicular to a plane including the direction of conveyance for a light-sensitive material even in the circulating direction of a processing solution. The reason for the foregoing is that uniformity 0f a way a processing solution hits a light-sensitive material was improved, and two or more outlets give remarkable effects.

E. It has been understood that uniformity of processing components in a processing tank can be improved greatly even by making an outlet for circulating solution to be nozzle-shaped so that a solution flow can be spread.

The means mentioned above can naturally be used independently to show an effect, but when they are used in combination, remarkable effects can be expected. A combination of all means gives the best improvement width.

The foregoing represents concrete means to which, however, the invention is not limited.

Though it is preferable that concentration of processing components does not scatter, scattering within 4% makes the invention to provide its effect substantially, reducing uneven development. However, it is preferable that scattering is within 3%. Further, occurrence of uneven development is influenced more by pH value scattering than by concentration scattering of processing agent components, and when the difference of pH value is larger than 0.1, uneven development occurs. It is therefore preferable that pH values do not scatter, but scattering of no more than 0.05 makes the invention to show its effect.

Concentration in a solution flow changes as time goes by depending on how solid processing agents are dissolved, and it causes an occurrence of uneven development. However, this can be improved by increasing the speed of solution flow, or by eliminating scattering of dissolved components by changing the structure of solid processing agents.

With regard to the control width, it is possible to change it by a method of combining the aforesaid attaining means (but not limited thereto).

Methods by means of the aforesaid concrete attaining means which are more preferable will be described below.

The number of outlets for circulating solutions is two or more, and the number of 5–2 is preferable. When the number is 6 or more, processing tanks of an automatic processing machine need to be larger in size and circulating paths need to more complicated, which cause a demerit of cost increase of the processing machine.

The number of circulating paths at a dispensing position for solid processing agents is at least one or more, and preferable number is 1–3. Even when 4 or more circulating paths are provided against space saving, to cope with a complicated automatic processing machine, an effect of improvement is small. The number of dispensing positions may be two or more without being limited to one. In that case, each dispensing position may be provided with its circulating path. For the purpose of accelerating dissolution of solid processing agents, it is preferable that the surface of the dispensing position is formed to be rough so that a solid processing agent may be scraped off.

With regard to a mesh used for an outlet, those whose mesh size is small enough are used so that insoluble components are trapped. However, the mesh size to be used needs to be one that causes neither clogging nor drop of flow rate.

It is preferable that an angle made between the direction of an outlet and the plane including the direction of conveyance for a light-sensitive material is a right angle. When the angle becomes more acute, the solution hits a light-sensitive material less evenly. Jetting out to the inside of rollers of an automatic processing machine (rollers sandwiching a light-sensitive material, in particular) is preferable on the point of uniformity.

It is preferable that a nozzle forms an angle of 45° or more in advance so that a circulating solution flow may be spread, and it is more preferable that the angle is 120° or less. If the angle exceeds 120°, the solution flow is spread excessively and jetting force is weakened. The angle of less than 45° provides poor effect. Though the effect of improving uneven development can be expected with one nozzle-shaped outlet, two or more outlets are preferable because the degree of improvement is enhanced.

However, 4 or more outlets are not preferable because an automatic processing machine needs to be complicated, a space needs to be increased, and jetting solutions positioned side by side hit each other and jetting forces are weakened.

The invention mentioned above shows a greater effect when the length between the conveyor rack and the jetting nozzles in the direction perpendicular to the conveyance direction for light-sensitive materials in a processing tank is 3.0 cm or more. When the discharging flow rate (from one nozzle) of a circulation flow is not less than 10.0 l/min and not more than 17.0 l/min, the effect is great. When the conveyance speed for light-sensitive materials is not less than 700 mm/min, the effect is great in particular.

For investigating whether the deviation in concentration is no more than 5% or not, 5 measurement points are selected with an equal distance in the direction perpendicular to the conveyance direction on positions at one side of the conveyor rack in which the jetting nozzles are provided at the other side of the conveyor rack and the measurement points are positioned within 1 cm from the conveyor rack and farthest from the jetting nozzles, and concentration of a processing solution is measured at each point selected. Though measurement, can be made any time in the course of continuous processing while replenishing solid processing agents, it is better to measure after processing 1.0 $m^2$ or more from the start of processing after starting the automatic processing machine. If each concentration at 5 points selected is within 5%, it is within the scope of the invention. It is possible to measure either by the use of a concentration sensor or by sampling processing solutions. For example, concentration of hydroquinone can be measured in the processing tank wherein a developing solution containing hydroquinone is housed. This measurement of concentration is only for check whether concentration dispersion is within 5% or not as performance of an automatic processing machine, and an automatic processing machine of the invention does not necessarily need to be provided with a concentration measuring means. However, it is preferable that concentration is measured constantly by a concentration sensor or the like, and the results of the measurement are fed back for concentration control. It is most preferable that all tanks of the automatic processing machine of the invention are provided with a means for keeping concentration dispersion to 5% or less. However, the invention shows its effect even when only one tank is provided with the means. In particular, it is preferable that a developing tank is provided with a means for keeping the dispersion to 5% or less.

As a factor to prevent fluctuation of photographic performance, it is effective to make a disclosure coefficient of a developing solution in an automatic processing machine small. A disclosure coefficient of not more than 80 $cm^2/l$ is preferable, in particular. When a disclosure coefficient exceeds 80 $cm^2/l$, insoluble solid processing agents or thick solutions immediately after dissolution tend to be oxidized by air, resulting in occurrence of insoluble substances or scums which cause problems of contaminating an automatic processing machine or processed light-sensitive materials. These problems are solved by the disclosure coefficient of not more than 80 $cm^2/l$. The disclosure coefficient in this case is represented by an area through which a unit volume of a processing solution is in contact with air, and a unit thereof is $cm^2/l$. In this invention, the disclosure coefficient of not more than 80 $cm^2/l$ is preferable, the disclosure coefficient of 50–3 $cm^2/l$ is more preferable, and that of 35–10 $cm^2/l$ is further preferable.

The disclosure coefficient can usually be made small by using air-blocking resins which serve as a floating lid, or it may be made small by a developing apparatus of a slit type described in Japanese Patent Application O.P.I. Nos. 63-131138, 63-216050 and 63-235940.

In the automatic processing machine of the invention, it is preferable that even when the conveyance of light-sensitive materials is stopped after the light-sensitive materials have been processed, a pump continues, from that moment of the stop, to be driven for a prescribed time period that is necessary for processing agents to be dissolved so that a processing solution may circulate. A period of time of not more than two hours is preferable for the pump to continue to be driven from the moment when processing is completed, and preferable, in particular, is a range of 10 minutes—70 minutes in which a range of 15 minutes—50 minutes is especially preferable. When this time period is too long, it is not preferable from the various points of view including easy operation, energy saving, deterioration of processing solutions and clogging in a filter. When it is too short, on the contrary, dissolution of solid processing agents tends to be insufficient.

The number of circulations of 0.5–2.0 circulations/min is preferable for a processing solution circulated by a circulating means in the invention, and especially preferable is 0.8–2.0 circulations/min wherein 1.0–2.0 circulations/min is further preferable. With this circulation, dissolution of solid processing agents is accelerated. It is further possible to prevent occurrence of a block of a thick solution, to prevent occurrence of uneven density on the processed light-sensitive materials, and to prevent occurrence of insufficiently processed light-sensitive materials. The number of circulations in this case shows an amount of circulated solution, and when the amount of circulated solution is the same as a total amount of solution contained in processing tanks, this is called one circulation.

What is claimed is:

1. An apparatus for processing a light-sensitive material, comprising:

a processing tank in which a processing solution is stored;

a dissolving tank in which a solid processing agent is dissolved, the dissolving tank communicating with the processing tank so that the processing solution flows between the dissolving tank and the processing tank;

a solid processing agent supply section for supplying the solid processing agent into the dissolving tank; and a supply controlling section for controlling an amount of the solid processing agents to be supplied per a unit time period in accordance with an amount of the light-sensitive material to be processed per a unit time period;

means for detecting a processing condition of the light-sensitive material, wherein the supply controlling section controls the amount of the solid processing agents to be supplied per the unit time period in accordance with the amount of the light-sensitive material to be processed per the unit time period based on a detection result of the detection means; and wherein the processing condition includes an intermittent processing and a continuous processing, and the amount of solid processing agent to be supplied per the unit time period in the intermittent processing is smaller than that in the continuous processing.

2. The apparatus of claim 1, wherein an amount of solid processing agent to be supplied per the unit time period in the course of switching from the intermittent processing to the continuous processing is larger than that in the continuous processing.

3. The apparatus of claim 1, wherein an amount of solid processing agent to be supplied per the unit time period in the course of switching from the continuous processing to the intermittent processing is smaller than that in the intermittent processing.

4. The apparatus of claim 1, wherein when the intermittent processing is switched to the continuous processing, the start of supply of the solid processing agent is made earlier by a predetermined time than the start of conveyance of the light-sensitive material.

5. The apparatus of claim 1, wherein when the continuous processing is switched to the intermittent processing, the start of supply of the solid processing agent is made later by a predetermined time than the start of conveyance of the light-sensitive material.

6. The apparatus of claim 1, wherein the supply control section controls an amount of the solid processing agent for each supply operation so that the amount of the solid processing agent is changed in accordance with the amount of the light-sensitive material to be processed per the unit time period.

7. The apparatus of claim 1, further comprising means for dissolving the processing agents, and a dissolution control section to control the dissolving means so that a dissolving speed of the solid processing agent is controlled in accordance with the amount of the light-sensitive material to be processed per the unit time period.

8. The apparatus of claim 7, further comprising means for detecting a processing condition of the solid processing agent, wherein the dissolving speed of the solid processing agent is controlled in accordance with the amount of the light-sensitive material to be processed per the unit time period on the basis of a detection result of the detection means.

9. The apparatus of claim 7, wherein the dissolving means changes a liquid flow in the dissolving tank.

10. The apparatus of claim 7, wherein the dissolving means changes vibration to be given to the liquid.

11. The apparatus of claim 7, wherein the processing tank includes a plurality of concentration sensors arranged in a direction perpendicular to a conveyance direction of the light-sensitive material, and the dissolving means controls the dissolving speed of the solid processing agent based on a concentration data from the concentration sensors.

12. The apparatus of claim 7, wherein the dissolving means changes a surface area of the solid processing agents to be supplied to the dissolving tank.

13. The apparatus of claim 1, further comprising a concentration distribution adjusting a deviation means for adjusting a concentration of the processing solution in a direction perpendicular to the conveyance direction of the light-sensitive material in the processing tank to be within 5%.

14. The apparatus of claim 1, further comprising a foam preventing means for preventing occurrence of foam in the dissolving tank.

15. The apparatus of claim 1, wherein the foam preventing means is one of a supersonic wave generating means for generating supersonic waves, a low frequency generating means for generating low frequencies, and an antifoaming agent mixed in the solid processing agent.

16. The apparatus of claim 1, further comprising a replenishing unit with a caster.

17. The apparatus of claim 16, wherein the replenishing unit includes a cartridge accommodating plural solid processing agents, a moving means for moving the cartridge to a predetermined supply position and a supply means for supplying plural solid processing agents in the cartridge set at a supply position to the dissolving tank.

18. The apparatus of claim 16, wherein the solid processing supply section is provided on a top plate covering an upper portion of the processing tank, and the replenishing unit includes lifting means to lift the cartridge to the upper portion so that the plural solid processing agents are fed from the cartridge to the solid processing supply section.

19. The apparatus of claim 16, wherein the solid processing supply section is provided on a top plate covering an upper portion of the processing tank, and the replenishing unit includes pressing means for feeding the plural solid processing agents from the cartridge to the solid processing supply section.

20. The apparatus of claim 16, wherein the solid processing agent is shaped in a form of a block, and the replenishing unit includes means for moving the block-shaped agent to a predetermined supply position and means for supplying the block-shaped agent from the predetermined supply position to the dissolving tank.

21. The apparatus of claim 1, further comprising a washing tank containing a washing solution for washing processed light-sensitive materials, an alkali agent dissolving tank in which an alkali solid adjusting agent is dissolved, the alkali agent dissolving tank communicating with the washing tank so that the alkali solid adjusting agent is supplied to the washing tank, and an alkali solid adjusting agent supply section to supply the alkali solid adjusting agent to the dissolving tank.

22. The apparatus of claim 21, further comprising detecting means for detecting at least on of a processing amount of the aforesaid light-sensitive materials and a PH value of washing water, and an adjusting agent supply controlling section for controlling an amount of the alkali solid adjusting agents to be supplied in accordance with the detection.

23. An apparatus for processing a light-sensitive material having a surface, comprising a processing tank in which a processing solution is stored;

conveyance means for conveying the light-sensitive material in a conveying direction so that the light-sensitive material is immersed in the processing solution;

a dissolving tank in which a solid processing agent is dissolved, the dissolving tank communicating with the processing tank;

a solid processing agent supply section for supplying the solid processing agents to the dissolving tank; and concentration distribution adjusting means for adjusting a deviation of a concentration of a processing agent in the processing solution in a direction perpendicular to the conveyance direction of the light-sensitive material in the processing tank to be within 5%, the concentration distribution adjusting means comprising circulating means for circulating the processing solution between the processing tank and the dissolving tank and a plurality of nozzles for jetting the processing solution onto the surface of the light-sensitive material, wherein the plurality of nozzles are arranged in the direction perpendicular to the conveying direction.

24. The apparatus of claim 23, wherein the concentration distribution adjusting means is circulating means that generates a plurality of circulation flows of a processing solution between the processing tank and the dissolving tank.

25. The apparatus of claim 24, wherein at least one of the plural circulation flows is a circulation flow with a flow direction perpendicular to the conveyance direction of the light-sensitive material.

26. The apparatus of claim 23, further comprising a plurality of concentration sensors provided in a direction perpendicular to the conveyance direction of the light-sensitive materials in the dissolving tank, and a control means for controlling the concentration distribution adjusting means based on a concentration data from the plural concentration sensors.

27. The apparatus of claim 23, further comprising circulating means used for the dissolving tank independently of the processing tank so that the processing solution circulates in the dissolving tank.

28. The apparatus of claim 23, further comprising filter means between the dissolving tank and the processing tank.

29. An apparatus for processing a light-sensitive material, comprising a processing tank in which a processing solution is stored;

conveyance means for conveying the light-sensitive material so that the light-sensitive material is immersed in the processing solution;

a dissolving tank in which a solid processing agent is dissolved, the dissolving tank communicating with the processing tank;

a solid processing agent supply section for supplying the solid processing agents to the dissolving tank; and concentration distribution adjusting means for adjusting a deviation of a concentration of the processing solution in a direction perpendicular to the conveyance direction of the light-sensitive material in the processing tank to be within 5%; and wherein said concentration distribution adjusting means is a circulating means that generates a plurality of circulation flows of the processing solution between the processing tank and the dissolving tank; said circulating means comprising a plurality of nozzles for jetting out circulation flows into the processing tank, and at least one of the nozzles having a shape to spread the jetting flow into the processing tank.

30. An apparatus for processing a light-sensitive material, comprising:

a developing tank in which a developing solution is stored;

a dissolving tank in which a solid developing agent is dissolved, the dissolving tank communicating with the developing tank so that the developing solution flows between the dissolving tank and the developing tank;

a solid developing agent supply section for supplying the solid developing agent into the dissolving tank;

a fixing tank in which a fixing solution is stored;

a washing tank containing a washing solution for washing processed light-sensitive materials;

an alkali agent dissolving tank having an alkali solid agent supply section by which an alkali solid agent for adjusting a pH value of the washing solution is dissolved in the alkali agent dissolving tank, the alkali agent dissolving tank communicating with the washing tank so that the dissolved alkali solid agent is supplied to the washing tank, and a conveyor for conveying the light-sensitive material sequentially to the developing tank, the fixing tank and the washing tank so that the light sensitive material is developed in the developing tank, fixed in the fixing tank, and washed in the washing tank, the conveyor having squeezing rollers for squeezing the washed light-sensitive material.

31. The apparatus of claim 30, further comprising detecting means for detecting at least one of a processing amount of the light-sensitive materials and a pH value of washing water, and an adjusting agent supply controlling section for controlling an amount of the alkali solid adjusting agents to be supplied in accordance with the detection.

* * * * *